US009240090B2

(12) United States Patent
Vogler et al.

(10) Patent No.: US 9,240,090 B2
(45) Date of Patent: Jan. 19, 2016

(54) SECURITY SHELVING APPARATUS AND METHOD FOR SECURELY STORING AND/OR DISPENSING RETAIL ARTICLES

(71) Applicant: Marketing Impact Limited, Concord (CA)

(72) Inventors: Michael Vogler, Concord (CA); Joel Pollock, Concord (CA)

(73) Assignee: Marketing Impact Limited, Concord, Ontario (CA)

( * ) Notice: Subject to any disclaimer, the term of this patent is extended or adjusted under 35 U.S.C. 154(b) by 295 days.

(21) Appl. No.: 14/011,390

(22) Filed: Aug. 27, 2013

(65) Prior Publication Data

US 2014/0061218 A1 Mar. 6, 2014

Related U.S. Application Data

(60) Provisional application No. 61/694,587, filed on Aug. 29, 2012.

(51) Int. Cl.

| | |
|---|---|
| ***A47F 1/04*** | (2006.01) |
| ***G07F 11/38*** | (2006.01) |
| ***G07F 11/42*** | (2006.01) |
| ***A47F 1/12*** | (2006.01) |

(52) U.S. Cl.

CPC ..... *G07F 11/38* (2013.01); *A47F 1/126* (2013.01); *G07F 11/42* (2013.01)

(58) Field of Classification Search

CPC ..... G07F 9/02; G07F 11/38; G07F 11/42; G07F 11/06; Y10T 16/4636; A47F 1/126; A47F 3/002; A47F 1/125

USPC ..... 211/59.3

See application file for complete search history.

(56) References Cited

U.S. PATENT DOCUMENTS

| | | | | |
|---|---|---|---|---|
| 4,887,737 | A | 12/1989 | Adenau | |
| 5,121,854 | A * | 6/1992 | Trouteaud et al. | 221/15 |
| 5,385,266 | A * | 1/1995 | Pate | 221/76 |
| 5,673,801 | A | 10/1997 | Markson | |
| 6,843,382 | B2 | 1/2005 | Kanouchi et al. | |
| 6,866,352 | B2 | 3/2005 | Fujii et al. | |
| 7,150,365 | B2 | 12/2006 | Hardy et al. | |
| 7,299,934 | B2 | 11/2007 | Hardy et al. | |
| 7,389,886 | B2 | 6/2008 | Hardy et al. | |
| 7,451,881 | B2 | 11/2008 | Hardy et al. | |
| 7,497,341 | B2 | 3/2009 | Hardy et al. | |
| 7,621,409 | B2 | 11/2009 | Hardy et al. | |
| 7,641,072 | B1 | 1/2010 | Vlastakis et al. | |

(Continued)

FOREIGN PATENT DOCUMENTS

| | | | |
|---|---|---|---|
| GB | 2386116 | A | 9/2003 |
| WO | 2005074635 | A2 | 8/2005 |

*Primary Examiner* — Korie H Chan

(74) *Attorney, Agent, or Firm* — Norris McLaughlin & Marcus, P.A.

(57) ABSTRACT

Systems and methods secure, store and/or dispense one or more retail items, and have at least one shelf and at least one product holder having a front portion, a back portion, a pusher paddle, at least one product stop ramp, and a level actuator. The systems and methods have a hinged front panel hinged, a blocker panel locatable in an engaged position or in an unengaged position, and at least one linkage connecting the front panel and the blocker panel, wherein the at least one portion of the level actuator is movable within the opening formed in the front panel to lift the associated forks above the stop ramp of the at least one product holder.

20 Claims, 31 Drawing Sheets

(56) References Cited

U.S. PATENT DOCUMENTS

| | | | | |
|---|---|---|---|---|
| 7,661,545 | B2 | 2/2010 | Hardy et al. | |
| 7,669,722 | B2 | 3/2010 | Hardy et al. | |
| 7,828,158 | B2 | 11/2010 | Colelli et al. | |
| 8,047,385 | B2 | 11/2011 | Hardy | |
| 8,113,601 | B2 | 2/2012 | Hardy | |
| 8,136,682 | B2 | 3/2012 | Hardy | |
| 8,190,289 | B2 | 5/2012 | Lockwood et al. | |
| 8,210,363 | B2 | 7/2012 | Hardy | |
| 8,215,520 | B2 | 7/2012 | Miller et al. | |
| 8,235,222 | B2 | 8/2012 | Hardy | |
| 8,235,227 | B2 | 8/2012 | Hardy | |
| 8,397,922 | B2 | 3/2013 | Kahl et al. | |
| 8,413,823 | B2 | 4/2013 | Hardy | |
| 2005/0161420 | A1 | 7/2005 | Hardy et al. | |
| 2008/0245811 | A1 | 10/2008 | Colelli et al. | |
| 2009/0184130 | A1 | 7/2009 | Miller et al. | |
| 2009/0223914 | A1 | 9/2009 | Kahl et al. | |
| 2009/0242582 | A1 | 10/2009 | Vlastakis et al. | |
| 2011/0017763 | A1 | 1/2011 | Colelli et al. | |
| 2011/0220597 | A1 | 9/2011 | Sherretts et al. | |
| 2011/0240569 | A1 | 10/2011 | Kahl et al. | |
| 2011/0315706 | A1 | 12/2011 | Lockwood et al. | |
| 2012/0006764 | A1* | 1/2012 | Hachmann et al. | 211/1.57 |
| 2012/0055892 | A1 | 3/2012 | Hardy | |
| 2012/0067917 | A1 | 3/2012 | Obitts et al. | |
| 2012/0273442 | A1 | 11/2012 | Hardy | |

* cited by examiner

SECURITY SHELVING APPARATUS AND METHOD FOR SECURELY STORING AND/OR DISPENSING RETAIL ARTICLES

CROSS REFERENCE TO RELATED APPLICATION

This application claims the benefit of U.S. Provisional Patent Application No. 61/694,587, filed Aug. 29, 2012, the entirety of which is hereby incorporated by reference into this application.

FIELD OF THE DISCLOSURE

The present disclosure relates to systems and methods for securely storing, displaying and/or dispensing one or more retail products.

BACKGROUND OF THE DISCLOSURE

Theft of retail items in retail stores is a major concern for most retailers. Retail items that are often the targets of shoplifters include, for example, over-the-counter retail products (hereinafter OTC products), which may include analgesics, cough and/or cold medications, razors, razor blades, camera film, batteries, videos, DVDs, smoking cessation products, infant formula and/or the like. For several reasons, preventing theft of these retail items and/or OTC products is often a priority for retailers and/or employees of the retailers. Retailers often provide shelving, security devices and/or other security measures that sometimes deter theft of these retail items and/or OTC products while granting limited access to customers that desire purchasing the retail items and/or OTC products.

Theft has become particularly problematic for certain retail items, such as, for example, cough and/or cold medications, razors, razor blades, infant formula and/or the like. Traditionally, these retail items are removed from shelves and are often placed behind store counters and/or securely stored under lock and key, only accessible by one or more employees of the retailers. This security approach is often effective in preventing theft of these retail items; however, such security approach often presents subsequent problems associated with access and availability of these retail items to customers desiring to purchase the retail items. For example, customers may often be deterred by having to request access to the retail items by an employee, in order to purchase the retail items. Further, such procedures require that the employee interrupt typical and usual duties in order to fulfill requests of the customers. Moreover, available space behind store counters for securely storing the retail items may be limited and/or non-existent. As a result, inventories of these retail articles may be at lower amounts than anticipated by customers which may undesirably lead to unavailability of the retail articles in times of need.

The systems and methods set forth in the present disclosure securely store, display and dispense retail articles in such a manner that effectively deters theft of the retail articles while also maintaining limited accessibility to the retail articles by customers.\

SUMMARY OF DISCLOSURE

In embodiments, a secure product dispensing apparatus, for one or more retail items having a front side and a rear side located opposite to the front side, may have a) at least one product holder adapted for holding the one or more retail items, wherein the at least one product holder may comprise: i) a front portion located adjacent to the front side of the apparatus; ii) a back portion located rearward with respect to the front portion of the at least one product holder; iii) a pusher paddle adapted for biasing the one or more retail items towards the front portion of the at least one product holder when the one or more retail items are positioned within the at least one product holder; iv) at least one product stop ramp adapted for restraining the one or more retail items from passing from the back portion to the front portion when the one or more retail items are positioned within the at least one product holder; and v) a level actuator having associated forks configured to lift at least one retail item over the product stop ramp such that the at least one retail item is movable from the back portion to the front portion of the product holder when the one or more retail items are positioned within the at least one product holder. The apparatus may also have b) a front panel hinged at a bottom edge of the front panel to the front side of the apparatus, wherein the front panel is adapted to move to an open position or a closed position, wherein the front panel, when located in the open position, is configured to allow manual access to the front portion of the product holder, or, when located in the closed position, is configured to block manual access to the product holder, wherein at least one portion of the level actuator extends outwardly with respect front panel. Further, the apparatus may have c) a blocker panel locatable in an engaged position or in an unengaged position, wherein the blocker panel, when located in the engaged position, is configured to block manual access to the back portion of the product holder and to allow manual access to the front portion of the product holder. Still further, the apparatus may have d) at least one linkage located between the front panel and the blocker panel such that the blocker panel is in the engaged position when the front panel is in the open position and the blocker panel is in the unengaged position when the front panel is in the closed position. When the one or more retail items are positioned within the at least one product holder, the at least one retail item may be manually accessible from the front portion of the product holder when the front panel is located in the open position and access to the one or more retail items located in the back portion of the product holder is blocked by the blocker panel when the front panel is located in the closed position.

In an embodiment, the apparatus may have at least one opening formed in the front panel, wherein the at least one opening is sized to receive the at least one portion of the level actuator.

In an embodiment, the at least one portion of the level actuator may be a handle that is movable in a substantially vertical direction.

In an embodiment, the at least one portion of the level actuator extending outwardly with respect to the front panel may be positioned between a top end of the front panel and a bottom end of the front panel that is located opposite to the top end of the front panel.

In an embodiment, the pusher paddle may be positioned in a forward angle with respect to the front side of the apparatus.

In an embodiment, the apparatus may have a pivot point for the hinged front panel that may be located below the level actuator.

In an embodiment, the apparatus may have an electronic alert system that may be coupled to at least one selected from the group comprising the front panel, the blocker panel, a handle of the front panel, a drawer locking mechanism and one or more night locks.

In an embodiment, the electronic alert system may be configured to produce an audible alert or a visual alert.

In an embodiment, the apparatus may have at least one product sensor in electronic communication with the electronic alert system.

In embodiments, a secure product dispensing apparatus may have a front side, a rear side located opposite to the front side, a top side and a bottom side located opposite to the top side. The apparatus may have a) at least one product holder adapted for holding the one or more retail items, wherein the at least one product holder may comprise: i) a front portion located adjacent to the front side of the apparatus; ii) a back portion located adjacent to the rear side of the apparatus; iii) a pusher paddle biased towards the front portion of the at least one product holder; iv) at least one product stop ramp located between the front and back portions of the at least one produce holder; and v) a level actuator having associated forks for lifting above the product stop ramp. The apparatus may also have b) a front panel hinged at a bottom edge of the front panel to the front side of the apparatus adjacent to the bottom side of the apparatus, wherein the front panel may be adapted to move to an open position or a closed position, wherein the front panel, when located in the open position, may be configured to allow manual access to the front portion of the product holder, or, when located in the closed position, may be configured to block manual access to the product holder, wherein at least one portion of the level actuator extends outwardly from an opening formed in the front panel. Further, the apparatus may have c) a blocker panel locatable in an engaged position or in an unengaged position, wherein the blocker panel, when located in the engaged position, is configured to block manual access to the back portion of the product holder and to allow manual access to the front portion of the product holder. Still further, the apparatus may have d) at least one linkage connecting the front panel and the blocker panel, wherein the at least one portion of the level actuator may be movable within the opening formed in the front panel to lift the associated forks above the stop ramp of the at least one product holder.

In an embodiment, the at least one portion of the level actuator may be a handle that may be movable in a substantially vertical direction.

In an embodiment, the apparatus may have a pivot point for the hinged front panel that may be located below the level actuator.

In an embodiment, the apparatus may have at least one retail item that may be positioned on the at least one product holder.

In embodiments, a method may securely store and/or dispense at least one retail item. The method may connect a product holder to a shelf frame having a front side, a back side located opposite with respect to the front side, a top side and a bottom side located opposite to the top side, wherein the product holder may be adapted to hold one or more retail items and may comprise: i) a front portion located adjacent to the front side of the apparatus; ii) a back portion located adjacent to the rear side of the apparatus; iii) a pusher paddle adapted for biasing the one or more retail items towards the front portion of the product holder when the one or more retail items are positioned within the product holder; iv) a product stop ramp located between the front and back portions of the product holder, where the product stop ramp is adapted to restrain the one or more retail items from passing from the back portion to the front portion of the product holder when the one or more retail items are positioned within the product holder; and v) a level actuator having associated forks configured to lift at least one retail item over the product stop ramp such that the at least one retail item is movable from the back portion to the front portion of the product holder when the one or more retail items are positioned within the at least one product holder. Further, the method may hinge a bottom edge of the front panel hinged to the front side of the shelf frame adjacent to the bottom side of the shelf frame, wherein the front panel may be moveable to an open position or to a closed position, wherein the front panel, when located in the open position, may allow manual access to the front portion of the product holder, or, when located in the closed position, may block manual access to the front portion of the product holder, wherein at least one portion of the level actuator may extend outwardly from an opening formed within the front panel. Still further, the method may connect a blocker panel to the front panel, wherein the blocker panel may be positionable in an engaged position or in an unengaged position, wherein the blocker panel, when located in the engaged position, may block manual access to the back portion of the product holder and may allow manual access to the front portion of the product holder, wherein the blocker panel may be in the engaged position when the front panel may be located in the open position and the blocker panel may be in the unengaged position when the front panel may be located in the closed position.

In an embodiment, the method may access the front portion of the product holder by moving the front panel to the open position.

In an embodiment, the method may block access to the front portion of the product holder by positioning the blocker panel in the engaged position.

In an embodiment, the method may lift the associated forks of the level actuator above the product stop ramp by moving the level actuator within the opening of the front portion.

In an embodiment, the method may position at least one retail item within the at least one product holder.

In an embodiment, the method may move the at least one portion of the level actuator located within the opening of the front panel such that the associated forks of the level actuator may lift the at least one retail product over the product stop ramp and into the front portion of the product holder.

In an embodiment, the method may manually access the at least one retail item from the front portion of the product holder by moving the front panel to the open position, wherein, when the front panel may be located in the open position, the blocker panel may block access to the back portion of the product holder.

BRIEF DESCRIPTION OF THE DRAWINGS

So that the features and advantages of the present disclosure can be understood in detail, a more particular description of the systems and methods, may be had by reference to the embodiments thereof that are illustrated in the appended drawings. It is to be noted, however, that the appended drawings illustrate only some typical embodiments of the present systems and methods and are therefore not to be considered limiting of its scope, for the systems and methods may admit to other equally effective embodiments.

DETAILED DESCRIPTION OF THE DISCLOSURE

Figure 1:
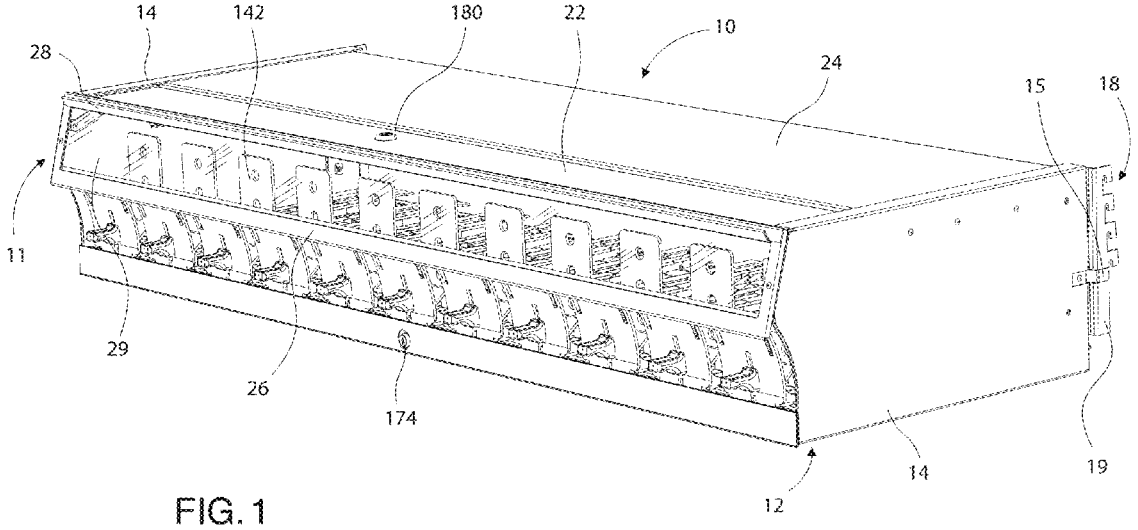
FIG. 1 illustrates a perspective view of a shelf system with a front panel located in a closed position in an embodiment.
Figure 2:
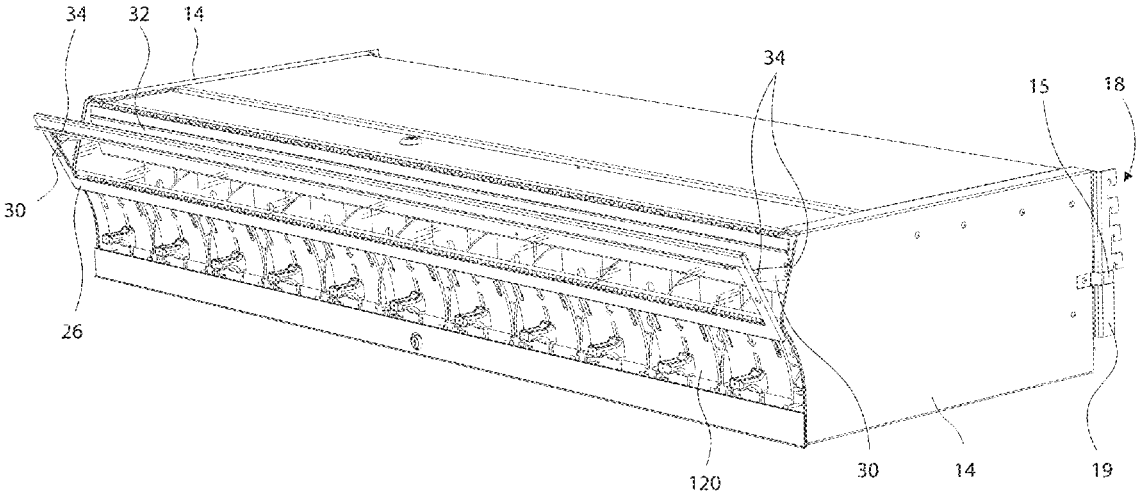
FIG. 2 illustrates a perspective view of a shelf system with a front panel located in an open position in an embodiment.

The present disclosure sets forth systems and methods for securely storing, displaying and/or dispensing one or more retail products. Referring now to the drawings wherein like numerals refer to like parts, the present systems and methods may provide at least one shelf frame 10, as shown in FIG. 1, configured to securely store, display and dispense one or more retail products 160 (hereinafter "products 160" which are shown in FIGS. 5A-5E). The products 160 may include, for example, consumer products, food products, hard goods, durable goods, soft goods, consumables, consumer-grade goods, professional-grade goods and/or the like. For example, the products 160 may include one or more razor blade packages, pharmaceuticals, analgesics, medications, camera films, batteries, videos, DVDs, smoking cessation products, infant formula, vitamins, personal care products, home care products and/or the like. Moreover, the products 160 that may be stored in, displayed by and/or dispensed from the shelf frame 10 may be any retail products known to one of ordinary skill in the art that are configured, adapted and/or sized to be located, stored and/or positioned within the shelf frame 10.

The products 160 may be located and/or stored within and/or positioned inside the shelf frame 10 which may be located inside, for example, a marketplace and/or a retail establishment. The marketplace and/or the retail establishment may be, for example, a chain store, a department store, a discount store, a grocery store, a hardware store, a health food store, a liquor store, a warehouse store, a variety store, a specialty store, a general store, a convenience store, a toy store, a pet store, an outlet store, a supermarket, a mall and/or the like. In embodiments, the shelf frame 10 may be associated with and/or incorporated into, for example, a vending machine, a portable sales device, a point of sale terminal and/or an automated retail store. The products 160 may be accessible singly or one at a time through a front-side 11 of the shelf frame 10. In embodiments, the products 160 may be accessible in combination or more than one at a time through the front-side 11 of the self frame 10. The products 160 which may be stored, displayed and/or dispensed via the shelf frame 10 may be same types of products 160, different types of products 160 and/or a combination of same and different types of products 160. The present disclosure should not be deemed as limited to a specific embodiment of the marketplace and/or the retail establishment wherein the shelf frame 10 may be located, included and/or incorporated.

Figure 14:
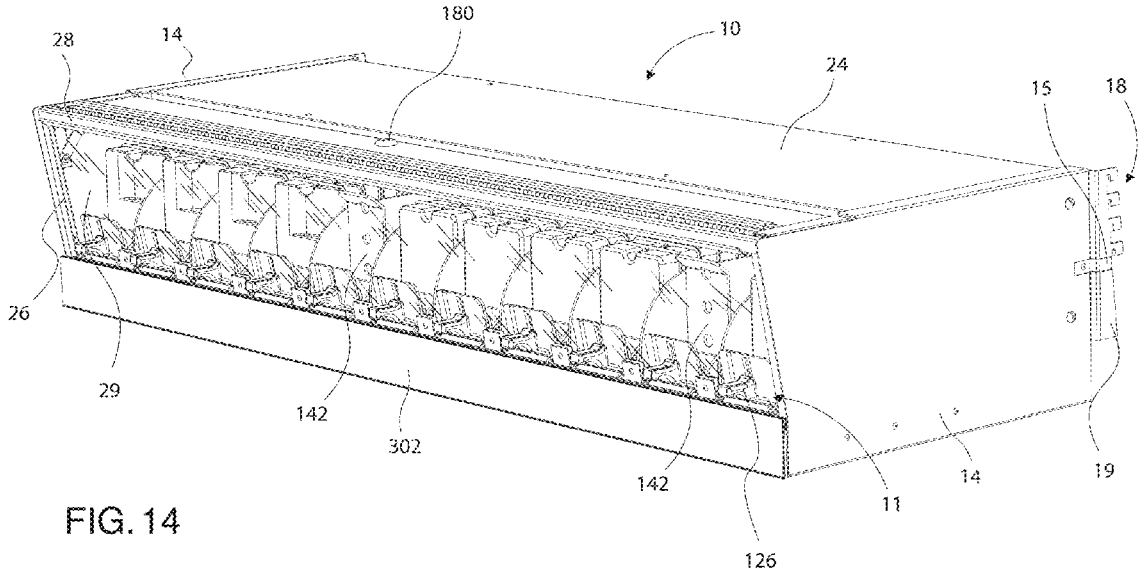
FIG. 14 illustrates a perspective view of a shelf system with a front panel located in a closed position in an embodiment.

FIGS. 1 and 14 shows a shelf frame 10 which may have a bottom panel 12 and outer side panels 14 (hereinafter "side panels 14"). The sides panels 14 may be connected via the bottom panel 12 such that the side panels 14 are located at opposite ends of the bottom panel 12. An interior 101 of the shelf frame 10, as shown in FIGS. 5A-5E, 18 and 21, may be described in more detail below, but may be generally configured and/or adapted for receiving, holding and/or storing at least one of the products 160 for dispensing and sale for value. In embodiments, one or more rows of the products 160 may be positioned, located and/or stored within the interior 101 of the shelf frame 10 as shown in FIG. 14.

Figure 19:
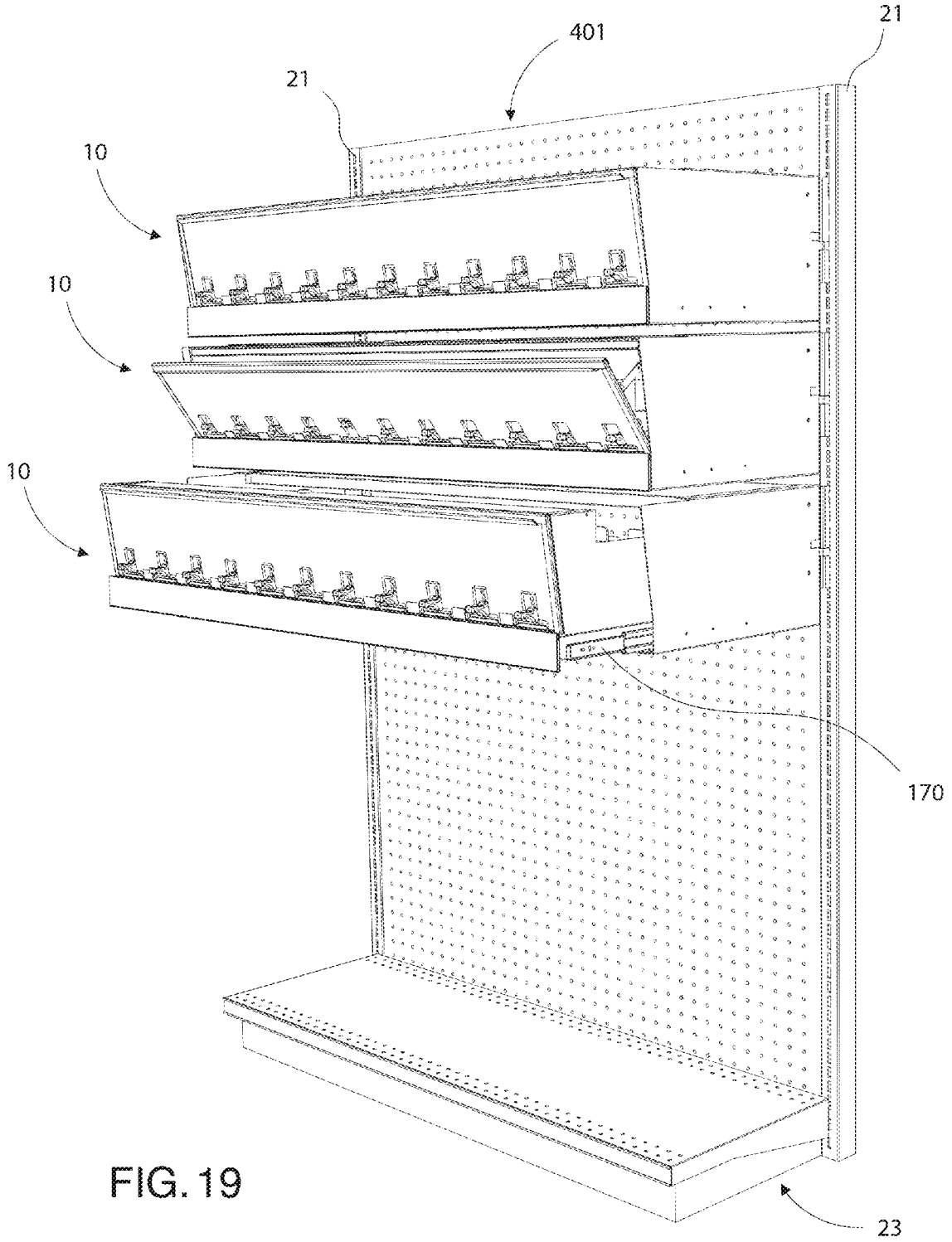
FIG. 19 illustrates three shelf systems mounted on top of each other and to an upright with one shelf system in an open and/or loading position in an embodiment.
Figure 20:
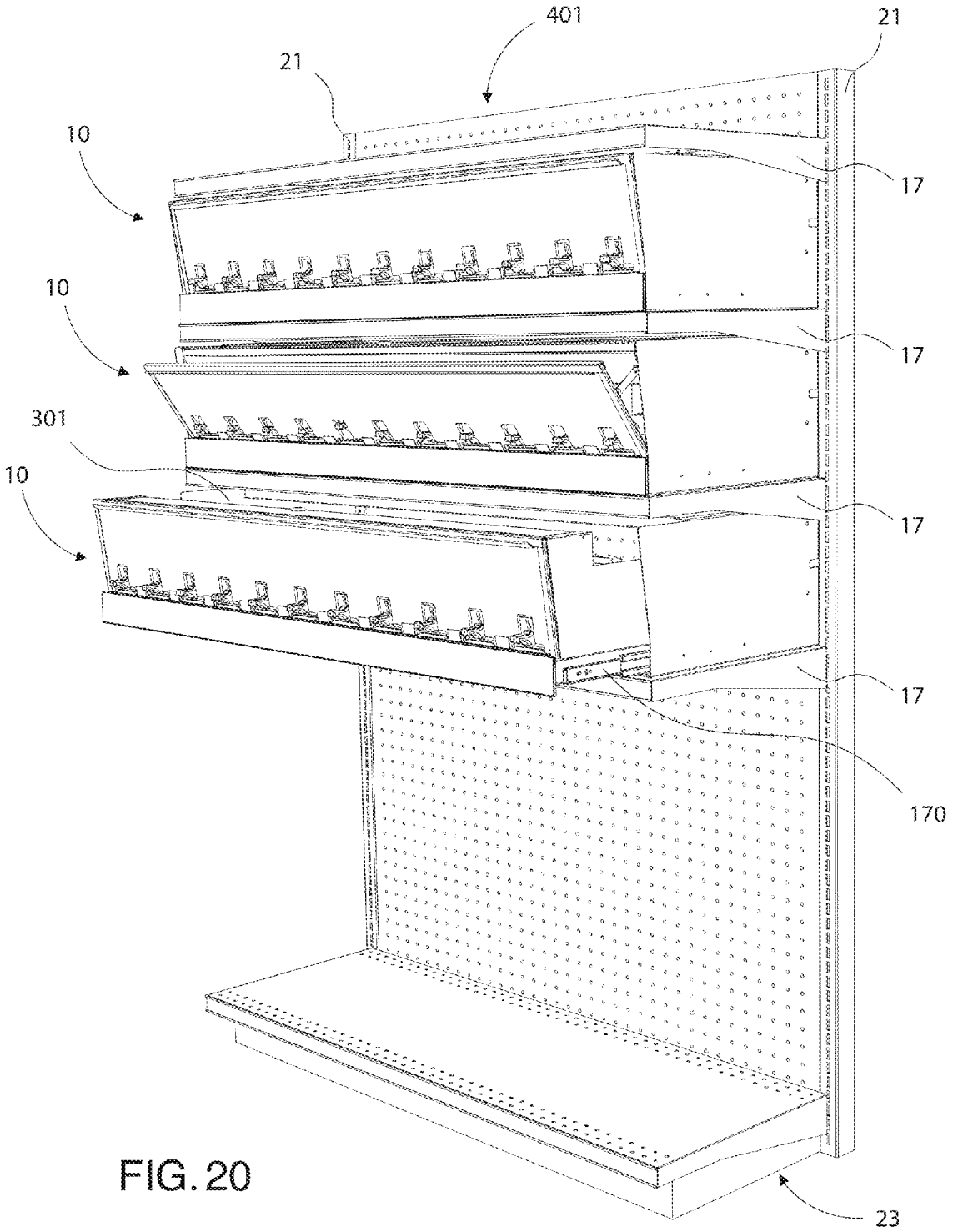
FIG. 20 illustrates three shelf systems mounted on top of each other and to store shelves with one shelf system in an open and/or loading position in an embodiment.
Figure 26:
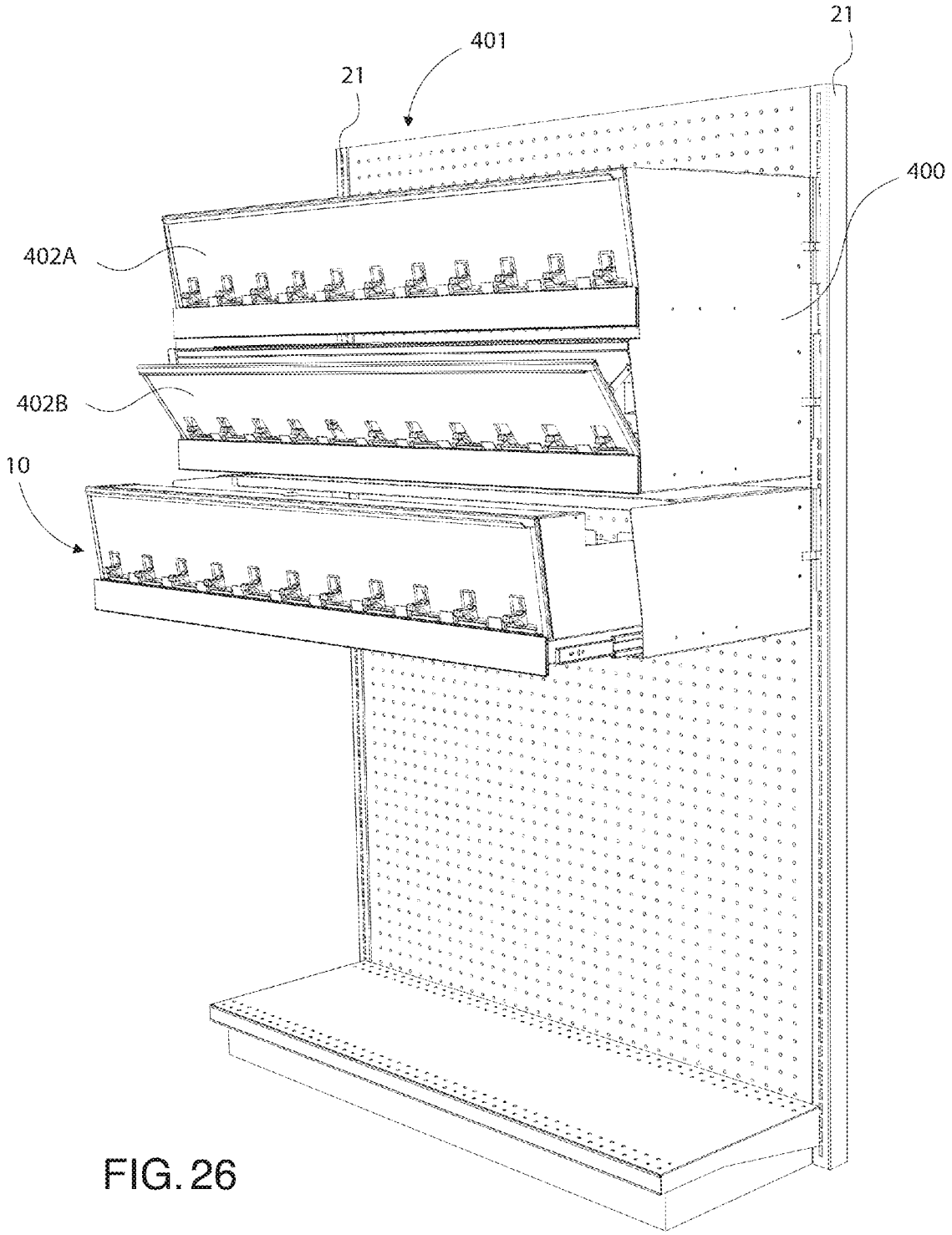
FIG. 26 illustrates three shelf systems having extended shelf frame mounted above a single shelf frame in an embodiment.

In embodiments, an expanded shelf frame 400 may be provided and/or attached, connected, fastened and/or secured to an aisle gondola 401, as shown in FIGS. 19, 20 and 26. The interior 101 of the expanded self frame 400 may be sized, adapted and/or configured to house, store and/or contain two or more interior frames 402*a*, 402*b* (hereinafter "frames 402*a*, 402*b*"). The frames 402*a*, 402*b* may be or may have a same, similar or substantially similar structure as the self frame 10. Further, the frames 402*a*, 402*b* may have same, similar or substantially similar structure features and functionalities as the self frame 10. The frames 402*a*, 402*b* may be independent and/or separate from one another or may be integrally formed together. The expanded self frame 400 and/or the frames 402*a*, 402*b* may provide and/or facilitate vertically space saving in the aisle gondola 404 and/or ease of setup for store employees. In an embodiment, the aisle gondola 401 may be configured, sized and/or adapted to provide and/or house one or more electrical and/or electronic alert or alarm features. It should be understood that the expanded self frame 400 may be sized, adapted and/or configured to house, store and/or contain any number of interior frames as known to one of ordinary skill in the art.

Figure 8:
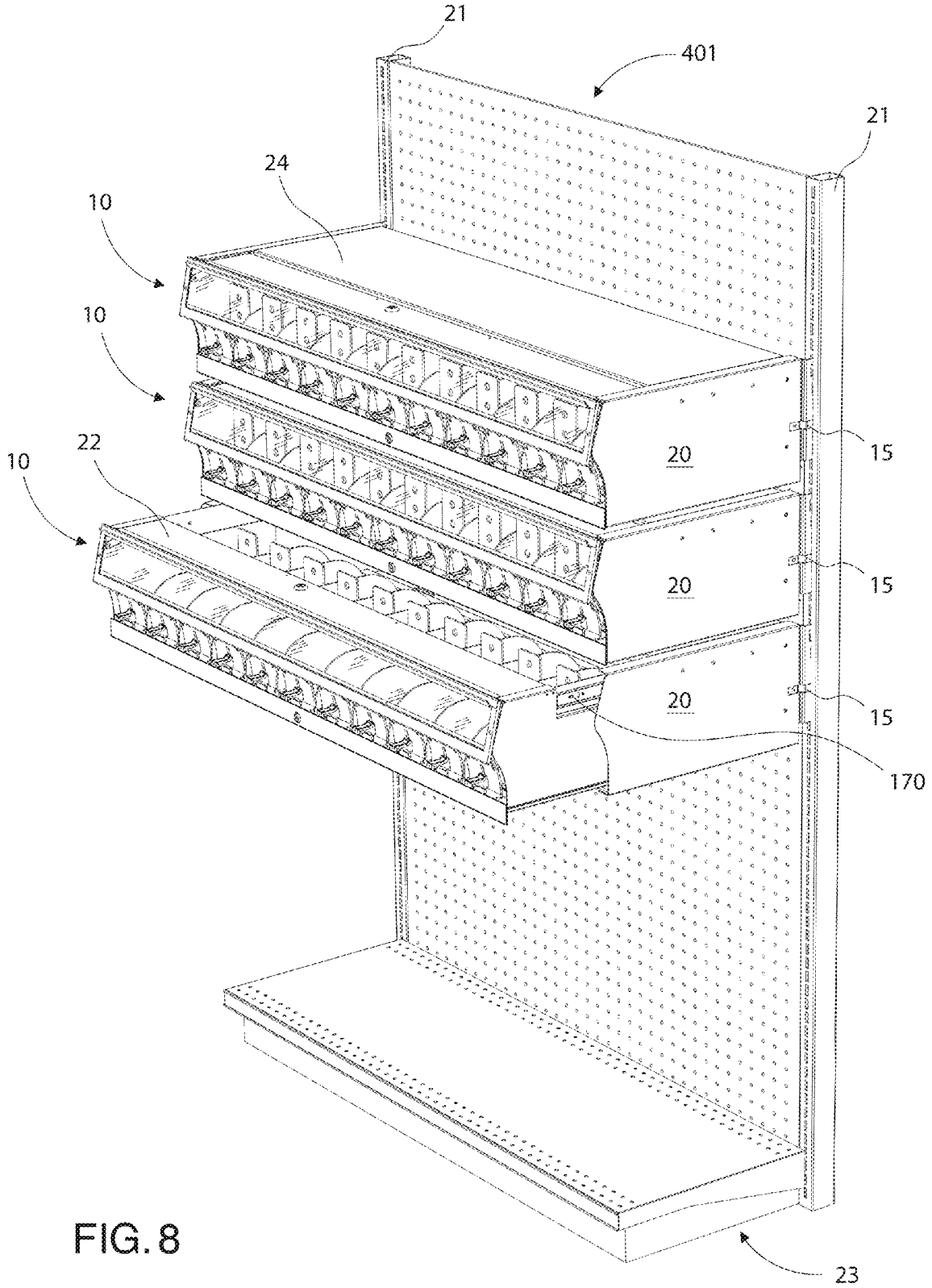
FIG. 8 illustrates three shelf systems mounted on top of each other and extending horizontally with one shelf system in an open and/or loading position in an embodiment.
Figure 9:
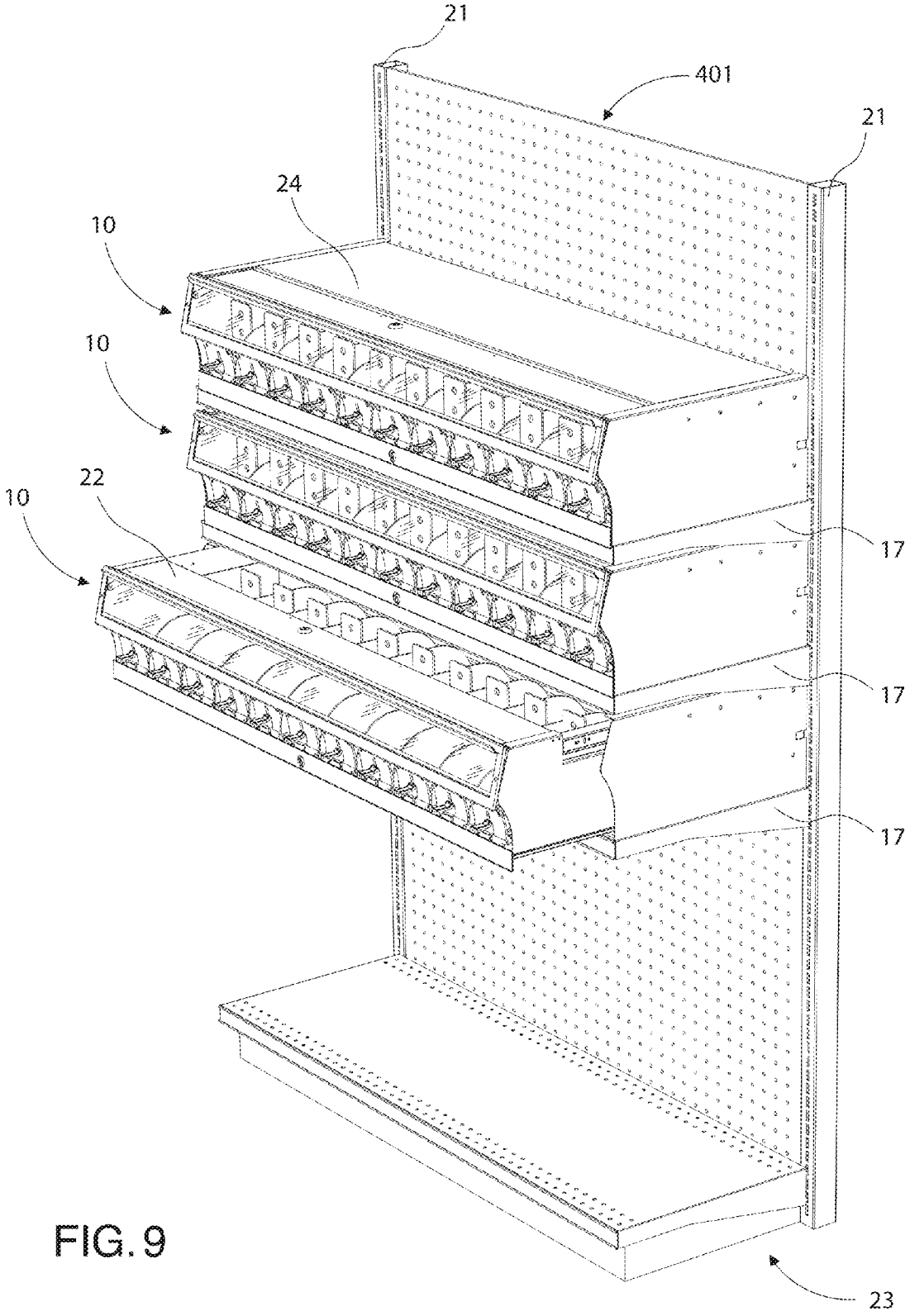
FIG. 9 illustrates three shelf systems fixed to shelves in an embodiment.
Figure 18:
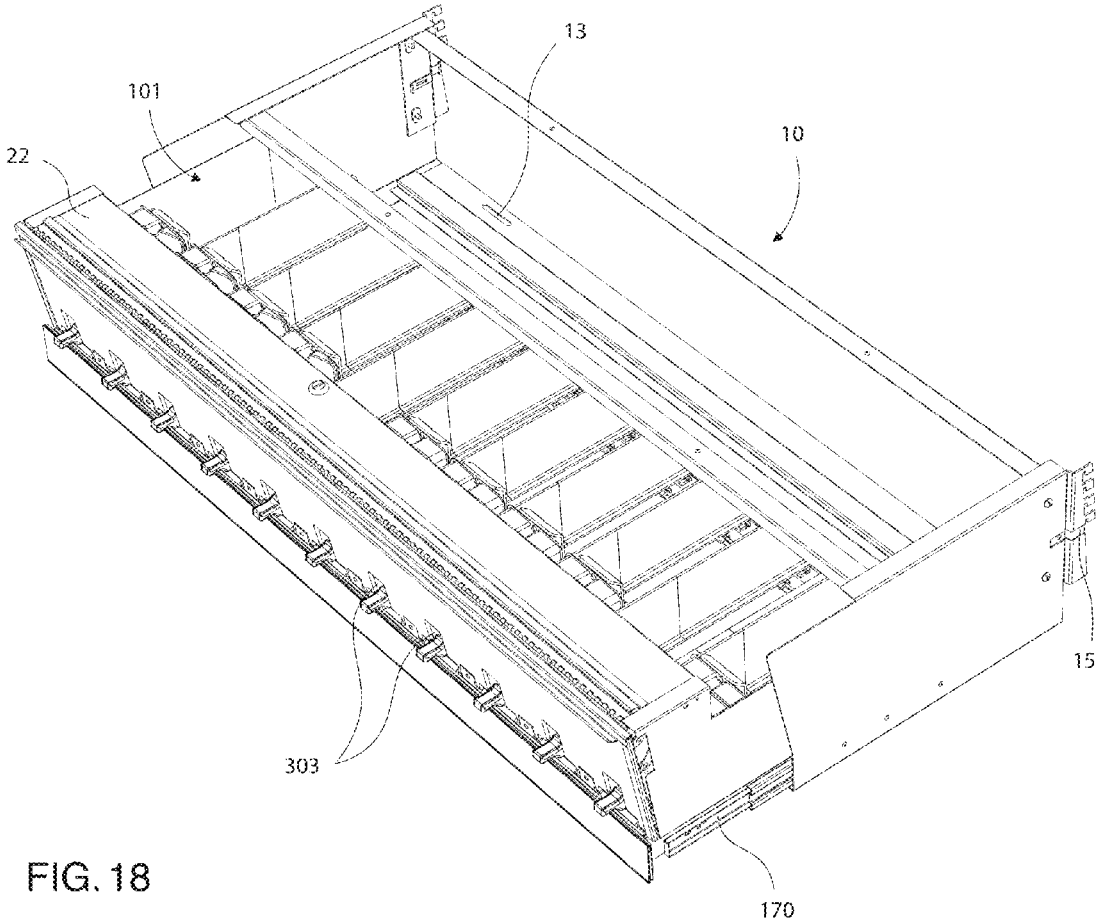
FIG. 18 illustrates a perspective view of a shelf system located in an open and/or loading position in an embodiment.
Figure 22:
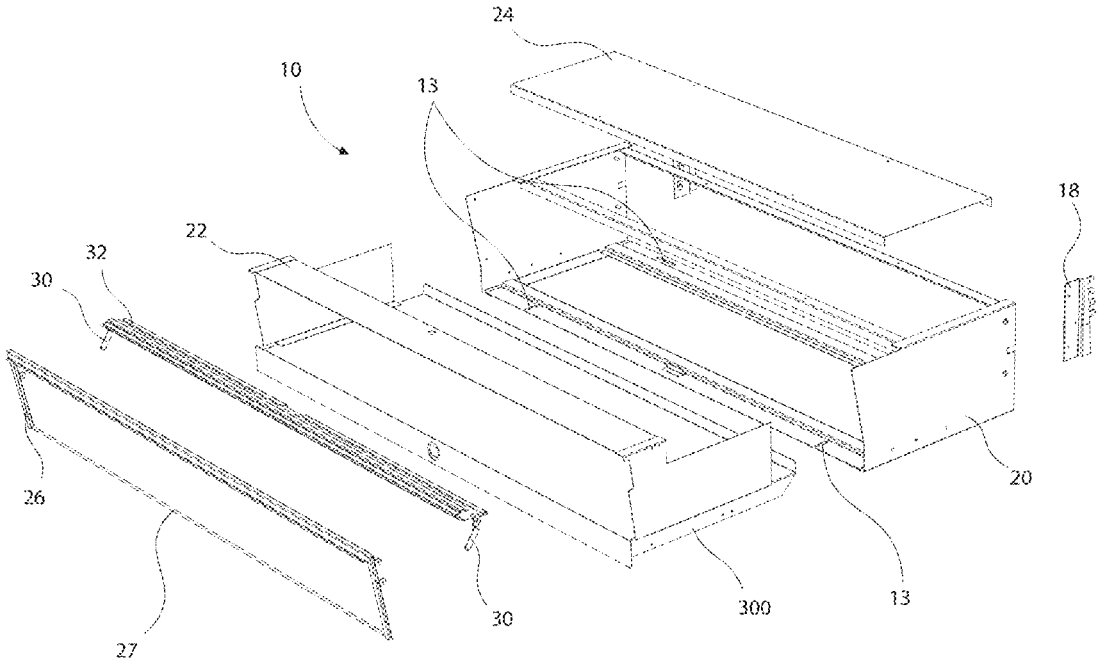
FIG. 22 illustrates an exploded view of a shelf system in an embodiment.

As shown in FIGS. 1, 2, 8, 9, 14, 19 and 20, at the rear of the shelf frame 10 may be one or more fastening means 18 (hereinafter "fastening means 18") which may be suitable to engage with one or more uprights 21 of, for example, a shelving unit 23 (as shown in FIGS. 8 and 9). As a result, the shelf frame 10 may be attached, connected, affixed and/or fastened to the one or more uprights 21 and/or the shelving unit 23 as shown in FIGS. 8 and 19. In embodiments, the fastening means 18 may be one or more bolts, screws, pins and/or fasteners which may be placed through one or more holes, such as, for example, one or more holes 13 (as shown in FIGS. 18 and 22) formed within the shelf frame 10. As a result, the shelf frame 10 may be secured to the shelving unit 23 via the one or more holes 13, the fastening means 18 and/or the uprights 21.

In an embodiment, the fastening means 18 may be removable, such as being integrated with one or more removable brackets 19 so that the brackets 19 may be removed when the shelf frame 10 may be attached only using the holes. As shown in FIGS. 9 and 20, the shelf frame 10 may be connected, attached and/or mounted to a shelf 17 which may be connected, attached and/or fastened to the uprights 21 of the shelving unit 23. The present disclosure should not be deemed as limited to a specific embodiment of the one or more holes 13 and/or the fastening means 18 for securing the shelf frame 10 to the uprights 21 and/or the shelving unit 23.

The shelf frame 10 may have a depth of, for example, twelve inches or sixteen inches in embodiments. Alternatively, the depth of the shelf frame may be customized and/or sized to fit with known store shelf and/or fixture depths. As a result, the shelf frame 10 may be less than twelve inches or greater than sixteen inches in embodiments. The present disclosure should not be deemed as limited to a specific depth of the shelf frame 10. Moreover, it should be understood the that depth of the shelf frame 10 may be any depth as known to one of ordinary skill in the art.

One or more slide locks 15 (as shown in FIGS. 1, 2, 5A-5E, 6, 8, 11, 14-16, 18 and 21) and/or at least one drawer lock mechanism 174 (shown in FIGS. 1, 6, 15 and 21) may be used to secure the shelf frame 10 to the uprights 21 and/or shelving unit 23 such that shelf frame 10 and/or the products 160 located therein are not removable from the uprights 21 or the shelf unit 23 without, for example, utilizing a key to unlock the one or more slide locks and/or the at least one drawer lock mechanism 174. The at least one drawer lock mechanism 174 may be referred to hereinafter as the drawer lock mechanism 174. In an embodiment, the one or more slide locks 15 may comprise at least one metal bar secured to the shelf frame 10 that may engage, contact and/or abut slots in the uprights 21 and/or the shelf 17 hindering or preventing the fastening means 18 from being lifted off and/or removed from the uprights 21. The one or more slide locks 15 may only be accessible from the interior 101 of the shelf frame 10, as shown in FIGS. 5A-5E. The drawer lock mechanism 174 may prevent the shelf frame 10 from being separated and/or removed from the uprights 21, the shelf 17 and/or the shelving unit 23. The drawer lock mechanism 174 may prevent or substantially prevent the shelf frame 10 from being moved to an open position such as to access the interior 101. In embodiments, the shelf frame 10 may be required to be moved to the open position to provide access to the one or more slide locks 15.

Figure 6:
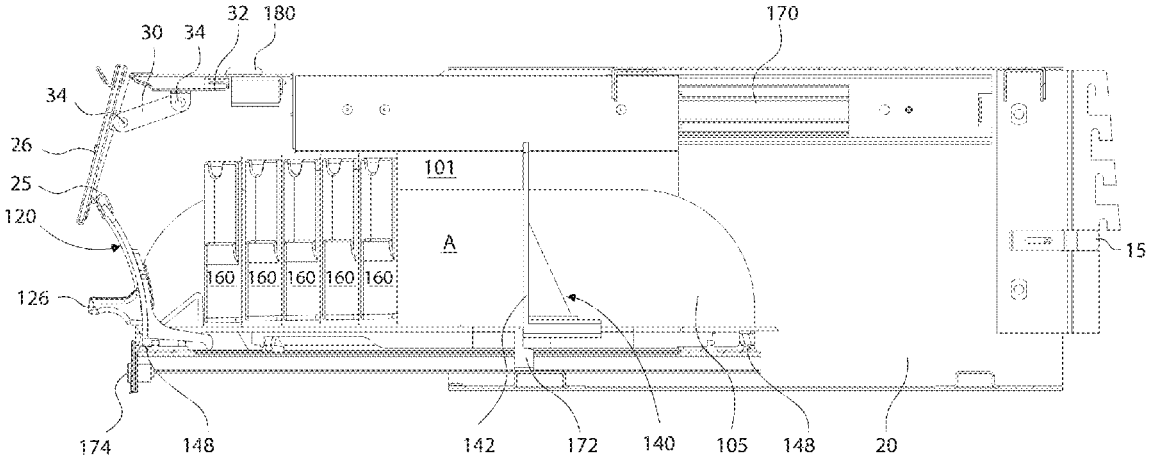
FIG. 6 illustrates a cross-sectional view of a shelf system and product holder located in an open and/or loading position in an embodiment.

The shelf frame 10 may have a structural plate 22 (hereinafter "plate 22") to secure tops of the side panels 14 as shown in FIG. 1. Instead of, or in addition to plate 22, the shelf frame 10 may have a top panel 24. The top panel 24 may be supported by and/or attached to one or more top bars 122 of a fixed frame portion 20 (as shown in FIGS. 6 and 22) of the shelf frame 10. The plate 22 and/or the top panel 24 may be provided on the shelf frame 10 when the shelf frame 10 may be position at a top shelf position of a vertical stack of more than one shelf frame 10 as shown in FIGS. 8 and 9. As a result, the plate 22 and/or the top panel 24 may prevent and/or substantially limit access to the products 160 located within the shelf frame 10 from a top side of the shelf frame 10, thereby preventing the products 160 from being removed from above the shelf frame 10. The plate 22 and/or the top panel 24 may be present on one or more shelf frames 10 to provide additional security for the products 160 located and/or stored therein. The shelf frame 10 may be placed on top of, or under, at least one additional shelf frame 10 or in shelving units with other types of shelves, as shown in FIGS. 8, 9, 19 and 20.

Figure 11:
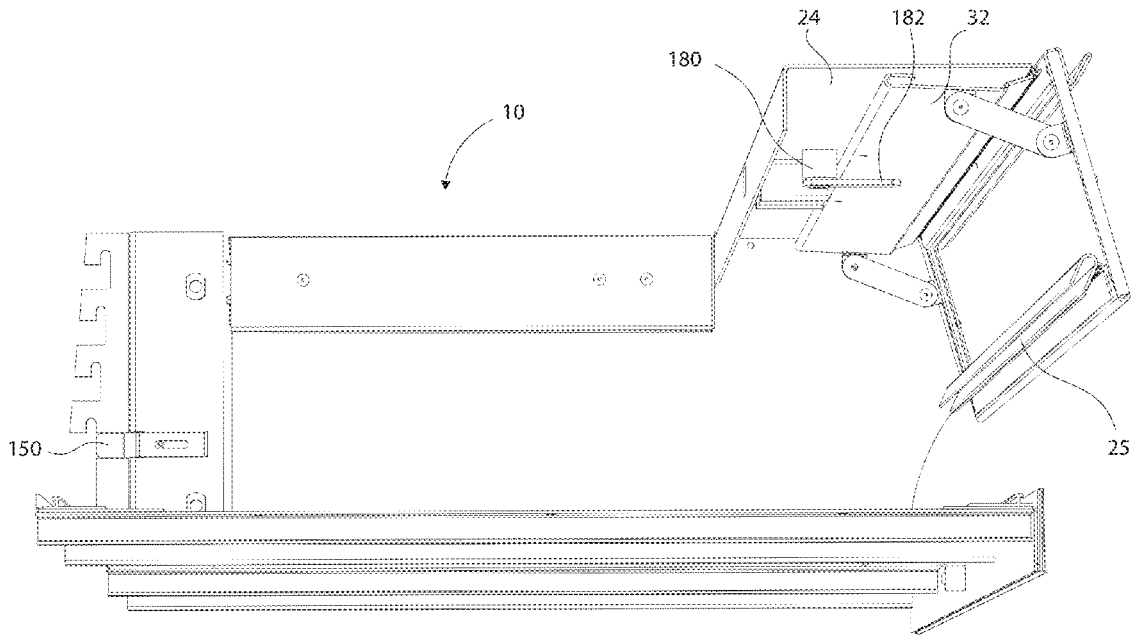
FIG. 11 illustrates a perspective view of a shelf system without product holders in an embodiment.
Figure 12A:
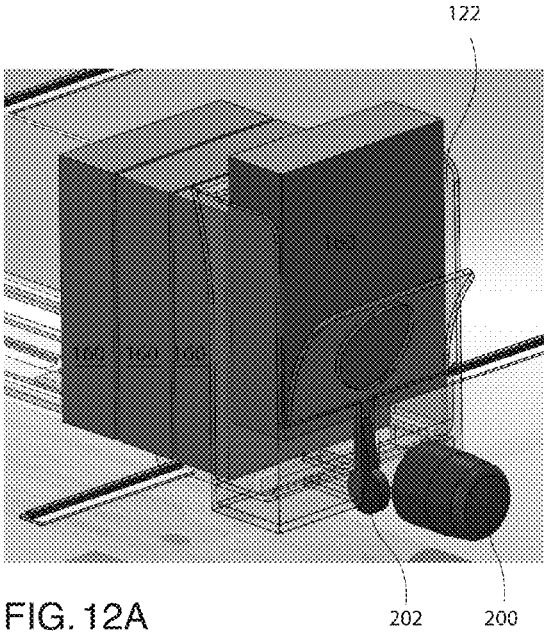
FIGS. 12A-12D illustrate side views of a security frame having an activator knob for turning a cam and/or raising at least one retail product in an embodiment
Figure 12B:
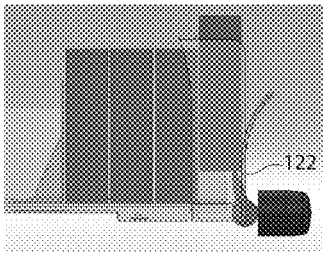
Figure 12C:
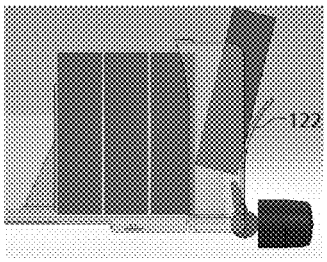
Figure 12D:
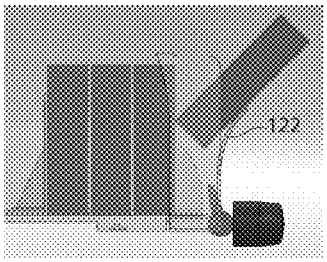
Figure 13A:
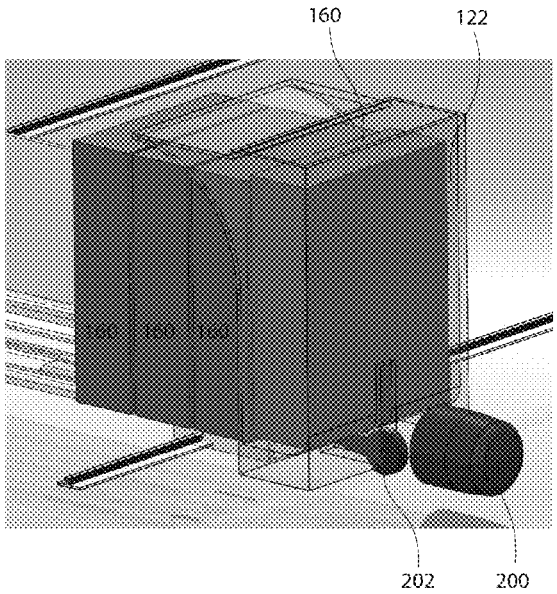
FIGS. 13A-13D illustrate side views of a security frame having an activator knob for turning a cam and/or raising at least one retail product in an embodiment.
Figure 13B:
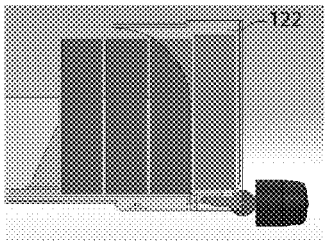
Figure 13C:
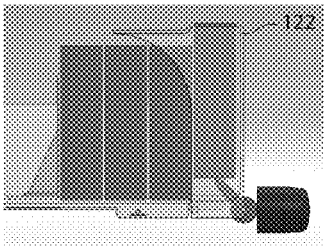
Figure 13D:
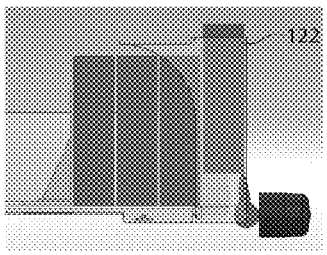
Figure 21:
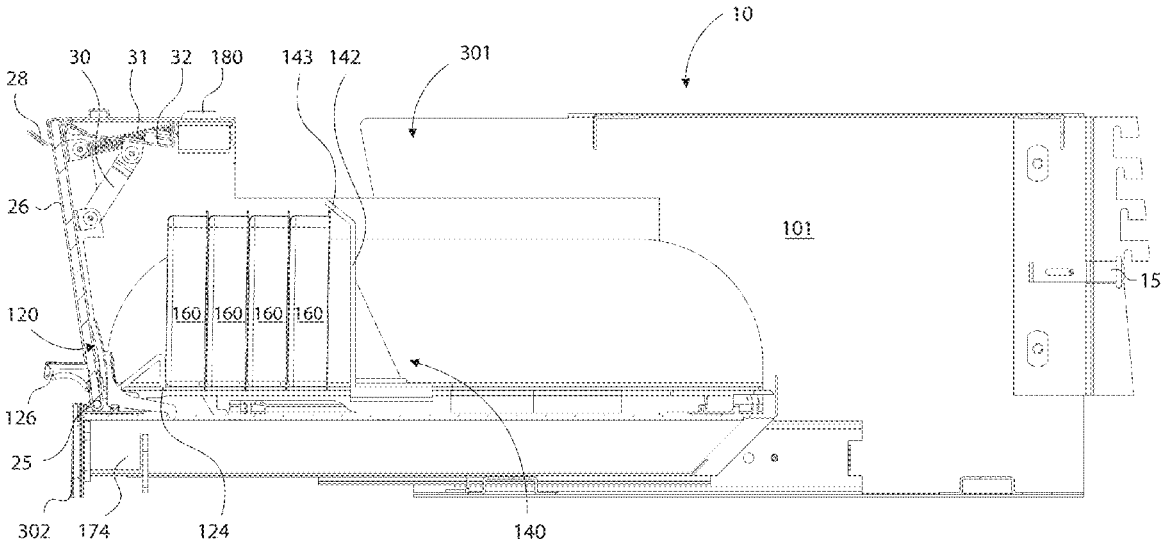
FIG. 21 illustrates a cross-sectional view of a shelf system located in a closed position in an embodiment.

A front panel 26 may be attached, connected and/or secured the shelf frame 10 via a pivoting or hinging mechanism 25 (hereinafter "hinging mechanism 25" as shown in FIGS. 6, 11 and 21). As a result, the front panel 26 may be located and/or positioned at the front-side 11 of the shelf frame 10. In embodiments, the front panel 26 may or may not cover substantially half of the front-side 11 of the shelf frame 10; although, the front panel 26 may cover a substantially larger or a substantially smaller portion than half of the front-side 11 of the shelf frame 10. For example, the front panel 26 may cover less than one-third of the front-side 11 of the shelf frame 10 or may cover a substantial entirety of the front-side 11 of the shelf frame 10. The hinging mechanism 25 may be located and/or positioned at and/or adjacent to a bottom edge 27 of the front panel 26 as shown in FIG. 11. The front panel 26 may or may not have a transparent or semi-transparent window 29 (hereinafter "window 29") in a portion or a substantial entirety of the front panel 26 as shown in FIG. 1. In embodiments, when the window 29 is provided, a consumer may be capable of visually seeing inside the shelf frame 10 and/or may view the products 160 located and/or stored therein via the window 29. As a result, the shelf frame 10 securely displays the products stored, located and/or positioned within the shelf frame 10 via the window 29.

Figure 16:
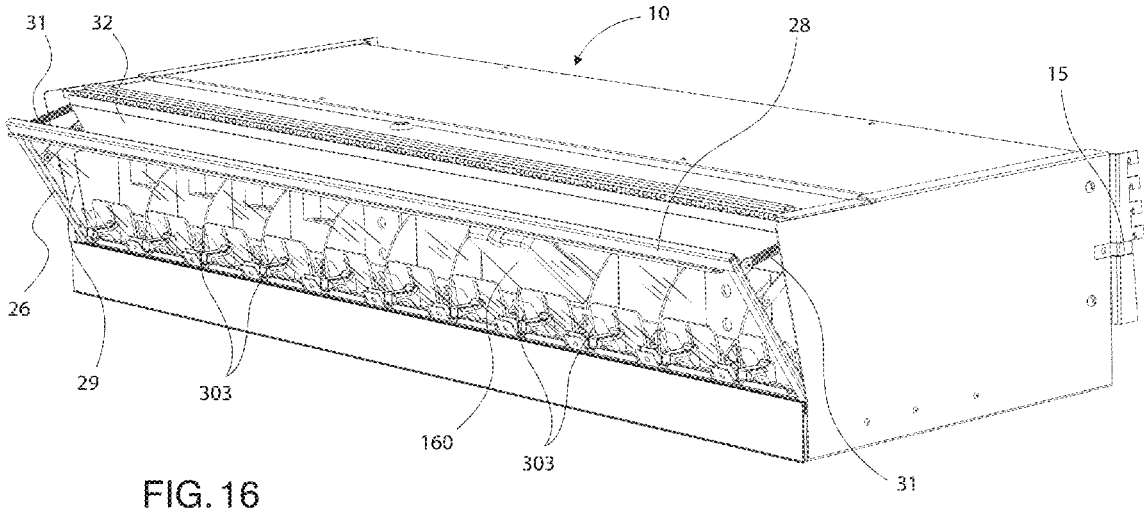
FIG. 16 illustrates a perspective view of a shelf system with a front panel located in an open position and a retail product being dispensed in an embodiment.

The front panel 26 may have a handle 28 connected to, attached to, affixed to or integrated with the front panel 26. The handle 28 may be utilized by a consumer to access the products 160 from inside the shelf frame 10 by moving the front panel to an open position as shown in FIGS. 5A-5E. The consumer may utilize the handle 28 to move the front panel 26 from a closed position to the open position via the hinging mechanism 25. By pivoting the handle 28 away from the shelf frame 10 and/or downward with respect to the top side of the shelf frame 10, the front panel 26 may move from the closed position to the open position. One or more spring 31 (as shown in FIGS. 16 and 21) may be provided between the front panel 26 and the shelf frame 10, the plate 22 and/or the top panel 24. The one or more spring 31 may be configured and/or adapted to apply a returning force to the front panel 26 such that the front panel 26 remains in and/or returns to the closed position unless the handle 28 is pivoted and/or moved downward and/or away from the shelf frame 10.

Linkage 30 may be provided to connect and/or link the front panel 26 to a blocker panel 32 as shown in FIGS. 2, 5A-5E, 6, 11 and 21. The linkage 30 may include one or more connecting elements 34 which may rotatably and/or pivotably connect and/or link the linkage 30 to the front panel 26 and blocker panel 32. In embodiments, the linkage 30 may be, for example, welded and/or directly fastened to the blocker door 32 and/or the front panel 26. In embodiments, the connecting elements 34 of the linkage 30 may include one or more pins, tabs, bolts, rivets, screws and/or the like. It should be understood that the connecting elements 34 may be any connecting elements as known to one of ordinary skilled in the art.

The blocker panel 32 may rotatably and/or pivotably connected, attached and/or hinge to the plate 22 and/or the top panel 24 as shown in FIGS. 11 and 21. In an upward position, the blocker panel 32 may be substantially aligned with and/or adjacent to the top panel 24 as shown in FIGS. 5A-5C, 6 and 21. With the blocker panel 32 in the upward position, at least one of the products 160 may pass and/or move beneath the blocker panel 32 without interference or substantial interference by the blocker panel 32. Further, the blocker panel 32 may be positioned so that at least one of the products 160 may be located and/or positioned between the blocker panel 32 and the front panel 26 of the shelf frame 10 when one of the products 160 may be dispensed. In an embodiment, one of the products 160 located within the shelf frame 10 may only fit between the blocker panel 32 and the front panel 26 of the shelf frame 10. In other embodiments, the shelf frame 10, the block panel 32 and/or the front panel 26 may be configured, adapted and/or sized such that two or more of the products 160 may be located and/or positioned between the blocker panel 32 and the front panel 26 of the shelf frame 10.

Figure 5A:
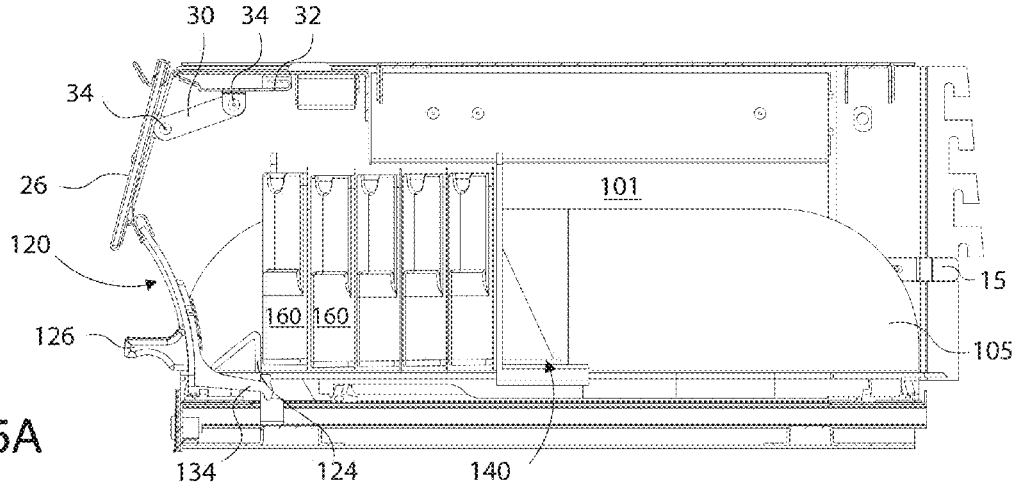
FIGS. 5A-5E illustrate cross-sectional side views of a shelf system and product holder in embodiments.
Figure 5B:
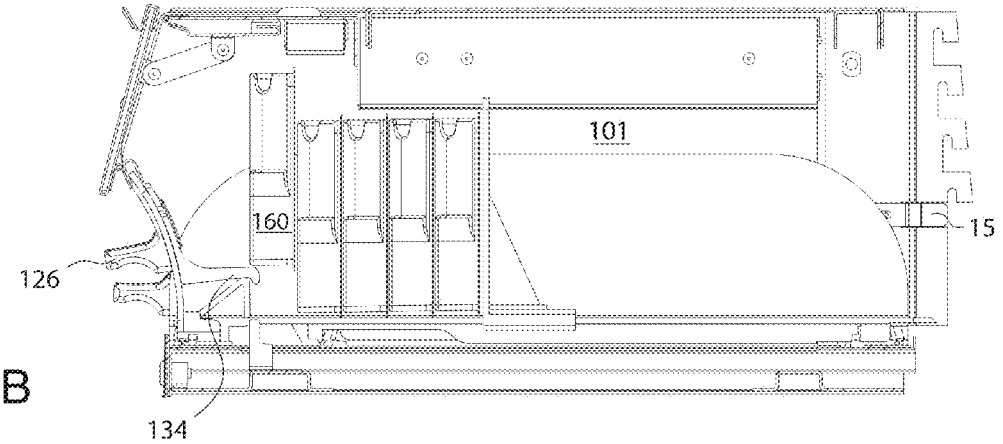
Figure 5C:
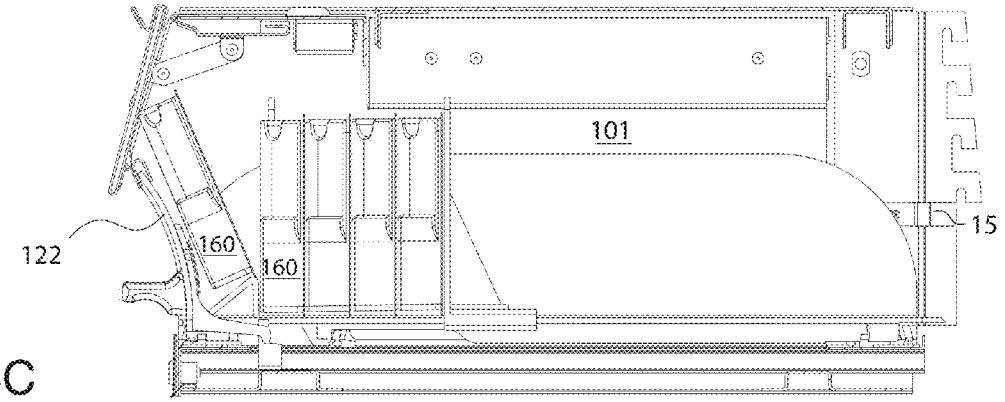
Figure 5D:
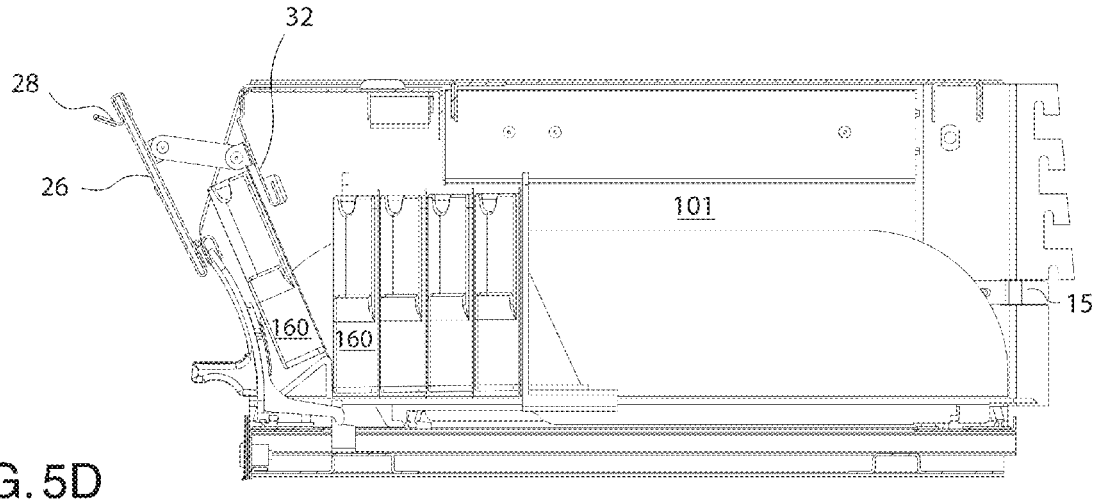
Figure 5E:
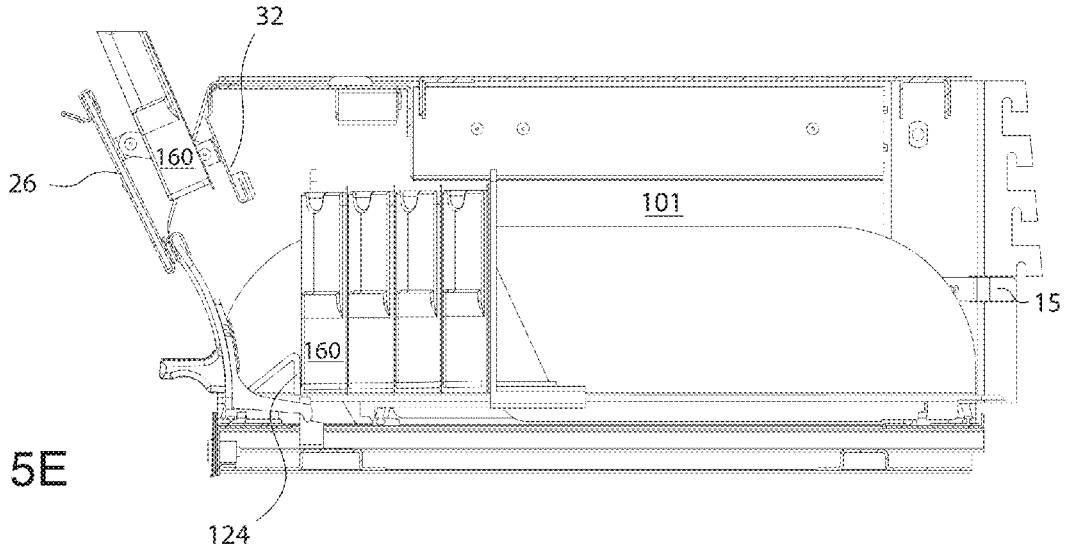

When the front panel 26 may be located in the open position, the linkage 30 may move, pivot and/or force the blocker panel 32 into a blocked position as shown in FIGS. 2, 5D, 5E and 16. In the blocked position, the blocker panel 32 may be positioned and/or oriented substantially vertically and/or angled such that the blocker panel 32 may interfere with and/or hamper or prevent movement of the products 160 behind the blocker panel 32 and/or within the interior 101 of the shelf frame 10 as shown in FIGS. 5D and 5E. As a result, access to the products 160 behind the blocker panel and/or within the interior 101 of the shelf frame 10 may be hampered or prevented by the blocker panel 32 when the blocker panel 32 is in the blocked position. Moving and/or returning the front panel 26 to the closed position may return the blocker panel 32 to the upward position which may be substantially aligned with and/or adjacent to the plate 22 and/or the top panel 24 of the shelf frame 10. The blocker panel 32 may be, for example, upwardly biased towards and/or to the upward position via the one or more springs 31 which may be attached and/or connected to at least one of the front panel 26 and/or the linkage 30. As a result, while the front panel 26 may be located in the open position, a consumer may access and/or obtain one of the products 160 that may be located between the front panel 26 and the blocker panel 32, while access to further and/or additional products 160 may blocked and/or prevented by the blocker panel 32 located in the blocked position.

The shelf frame 10, the bottom panel 12, the side panels 14, the plate 22, the top panel 24, the linkage 30, the blocker panel 32, the connecting element 34 and/or any other components of the shelf frame 10 may be made from at least one metal material, hard plastic material and/or a combination thereof. In embodiments, metal material may include, for example, stainless steel, formed metal sheet goods, metal tubing, galvanized metal, powder coated metal and/or the like. In embodiments, metal material of one or more of the shelf frame 10, the bottom panel 12, the side panels 14, the plate 22, the top panel 24, the linkage 30, the blocker panel 32, the connecting element 34 and/or any other components of the shelf frame 10 may have same thicknesses or varying thicknesses. Hard plastic material may include, for example, polycarbonate, high impact styrene, acrylonitrile butadiene styrene, co-polyester sheet and/or the like. The present disclosures should not be deemed as limited to a specific embodiment of the metal material and/or the hard plastic material which may be usable for one or more of the shelf frame 10, the bottom panel 12, the side panels 14, the plate 22, the top panel 24, the linkage 30, the blocker panel 32, the connecting element 34 and/or any other components of the shelf frame 10. One or more of the thicknesses of the metal material and/or the hard plastic material may be any thicknesses as known to one of ordinary skill in the art.

FIGS. 3, 5A-5E and 6 shows the shelf frame 10 may include one or more product holders 100 (hereinafter "the holders 100"). Each of the holders 100 may hold and/or support one or more of the products 160 and/or may be substantially aligned with and/or adjacent to the side panels 14 of the shelf frame 10. Each of the holders 100 may be accessible to a consumer at the front-side 11 of the shelf frame 10 through an opening formed between the front panel 26, the shelf frame 10 and the blocker panel 32 when the front panel 26 is located in the open position and/or the blocker panel 32 is located in the blocker position.

Figure 7:
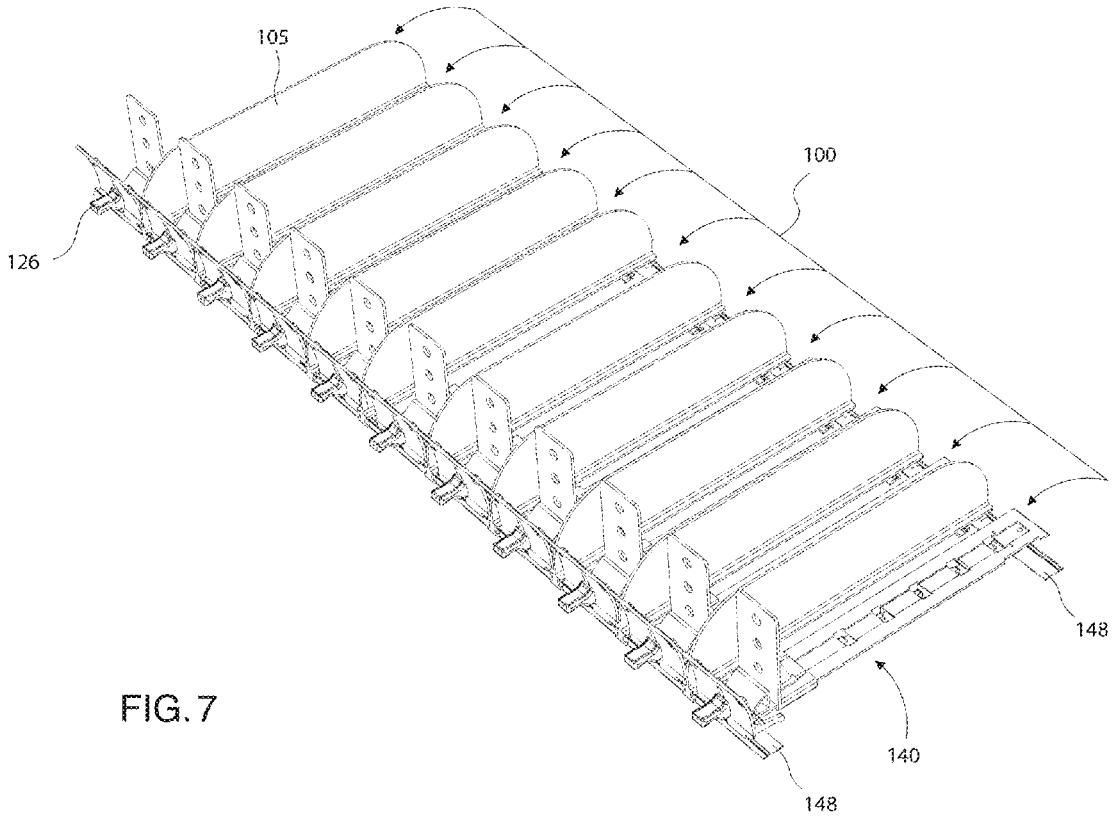
FIG. 7 illustrates a perspective view of more than one product holder which are positionable within a shelf system in an embodiment.
Figure 17:
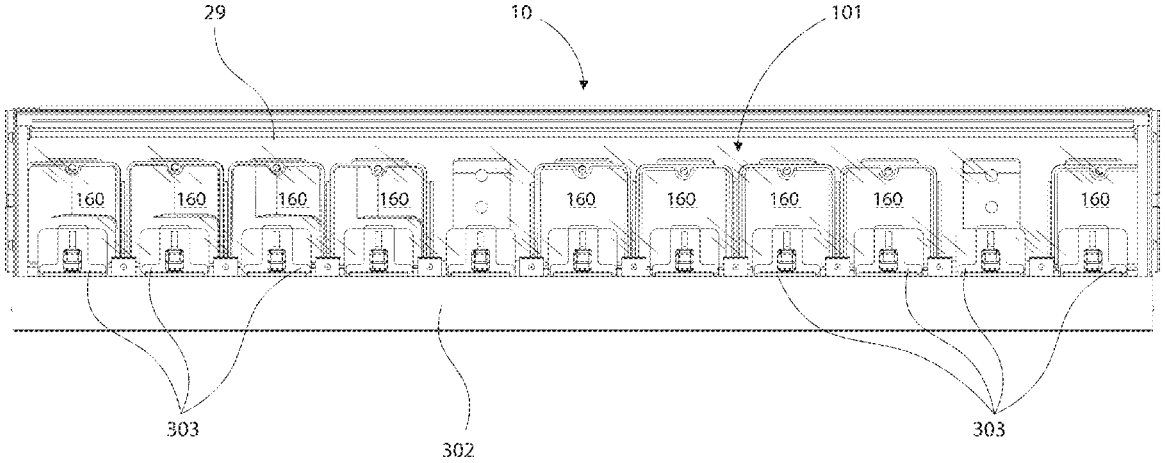
FIG. 17 illustrates a front plan view of a shelf system with a front panel located in a closed position with retail products being securely stored and displayed therein in an embodiment.

Between each of the holders 100 may be one or more dividers 105 (hereinafter "dividers 105") which may be sized and/or configured to maintain and/or retain positions of the products 160 such that the products 160 remain positioned on their respective the holders 100. As a result, the shelf frame 10 may display a number of product facings for the products 160 based on a number of dividers 105 that may be positioned and/or located within the shelf frame 10. Each of the product facings are defined by one of the holders 100 and two of the dividers 105 or by one of the holders 100, one of the dividers 105 and one of the side panels 14. In an embodiment, a shelf frame 10 may have, for example, eleven product facings for products 160 with ten dividers as shown in FIGS. 7 and 17. A number of holders 100 and a number of dividers 105 utilized within the interior 101 of the shelf frame 10 may depend on a width of the shelf frame 10 and/or a width or size of the products 160 to be located within the interior 101 of the shelf frame 10. Moreover, the numbers of holders 100 and/or dividers 105 may be determinable by any method known to one of ordinary skill in the art. A position of the holders 100 may be adjustable within the shelf frame 10 which may allow the same shelf frame 10 to be usable with different products 160 having different shapes and/or sizes as shown in FIG. 17.

In an embodiment, the holders 100 may be attached and/or connected to rails 148 as shown in FIGS. 6 and 7. In an embodiment, the rails 148 may be, for example, snap tracks or other rails as known to one of ordinary skill in the art. The rails 148 may be attached, connected and/or affixed to the shelf frame 10 and/or the interior 101 of the shelf frame 10. As a result, the holders 100 may be located and/or positioned on the rails 148 at appropriate locations which may be based on and/or determinable by a number of product facings for the products 160 and/or shape(s) and/or size(s) of the products 160. The holders 100 may be attached and/or connected to the rails 148 using at least one mount (not shown in the drawings) which may snap and/or lock into the rails 148 and/or which may also be unlocked and repositioned if desired. The at least one mount may include, for example, snap tracks or other mounts as known to one of ordinary skill in the art. In embodiments, the rails 148 may be mechanically attached, connected and/or secured to an inside frame 300 (as shown in FIG. 22) of the shelf frame 10. The present disclosure should not be deemed as limited to a specific embodiment of the at least one mount for attaching and/or connecting the rails 148.

As shown in FIGS. 1-4, 6, 10A-10C, 23 and 24, each of the holders 100 may have a lever actuator 120 accessible at the front-side 11 of the shelf frame 10 below the front panel 26 when the holders 100 are located and/or positioned within the shelf frame 10. The lever actuator 120 may have a dispenser body 122 that may be integrated with and/or connected and/or attached to a product stop ramp 124 (hereinafter "the ramp 124"). The dispenser body 122 may be connect, attach and/or affix to and/or may substantially abut the front panel 26, the bottom panel 12, the side panels 14 and/or the shelf frame 10. In embodiments, the dispenser body 122 may have a curved cross-section to increase accessibility to the products 160 when the front panel 26 is located in the open position and the blocker panel is located in the blocked position. In embodiments, the dispenser body 122 may be substantially flat or shaped to cooperate with a shape of the products 160 for easier dispensing of the products 160 when the front panel 26 is located in the open position and/or the blocker panel 32 is located in the blocked position. In embodiments, the hinging mechanism 25 of the front panel 26 may be connected and/or attached to a top end 125 of the dispenser body 122 as shown in FIG. 6. As a result, the front panel 26 may be pivotable and/or rotatable with respect to the level actuator 120, the dispenser body 122 and/or the shelf frame 10 via the hinging mechanism 25. For example, when the front panel 26 and/or the handle 28 are moved and/or pulled away or downwardly from the plate 22 and/or the top panel 24 of the shelf frame 10, the top panel 26 pivots, via the hinging mechanism 25, and moves to the open position and the blocker panel 32 moves to the blocker position. As a result, the opening between the front panel 26, the blocker panel 32 and/or the shelf frame 10 is provided such that one of the products 160, located in the opening and between the front panel 26 and the blocker panel 32, is accessible and/or dispensable from the shelf frame 10.

Figure 4:
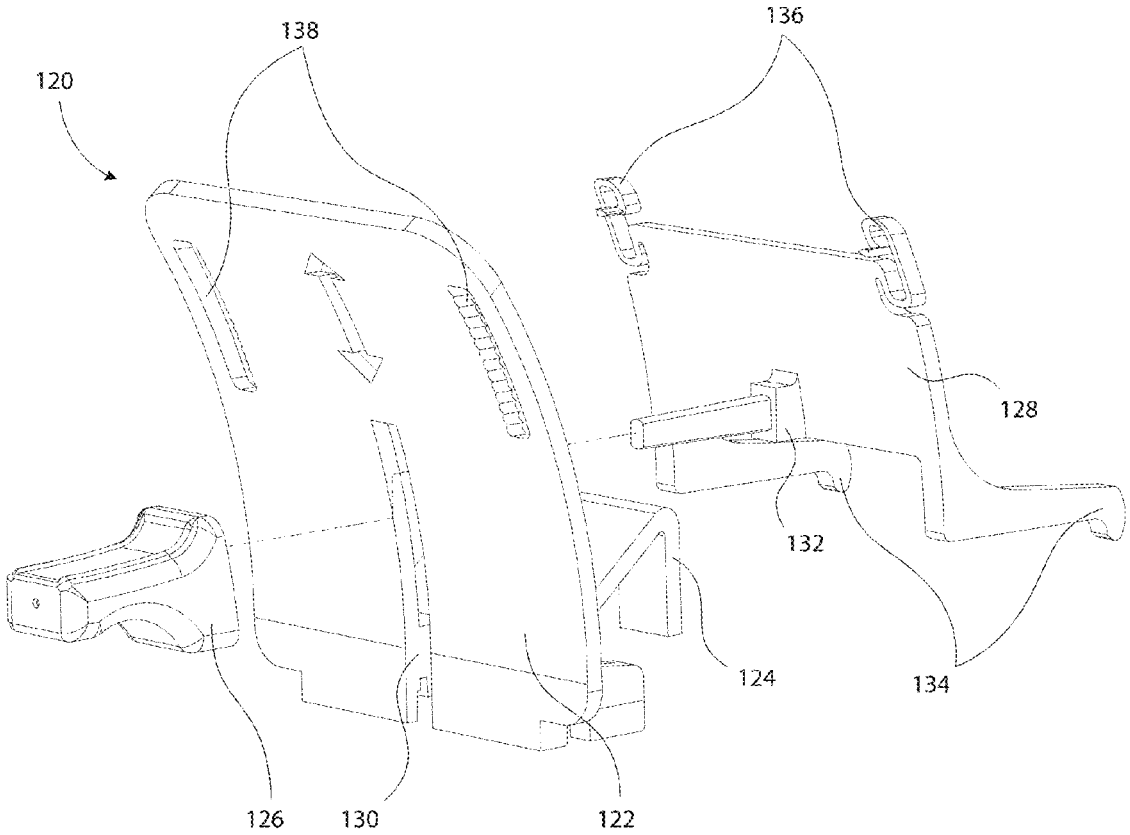
FIG. 4 illustrates an exploded perspective view of a lever actuator of the product holder as shown in FIG. 3 in an embodiment.
Figure 23:
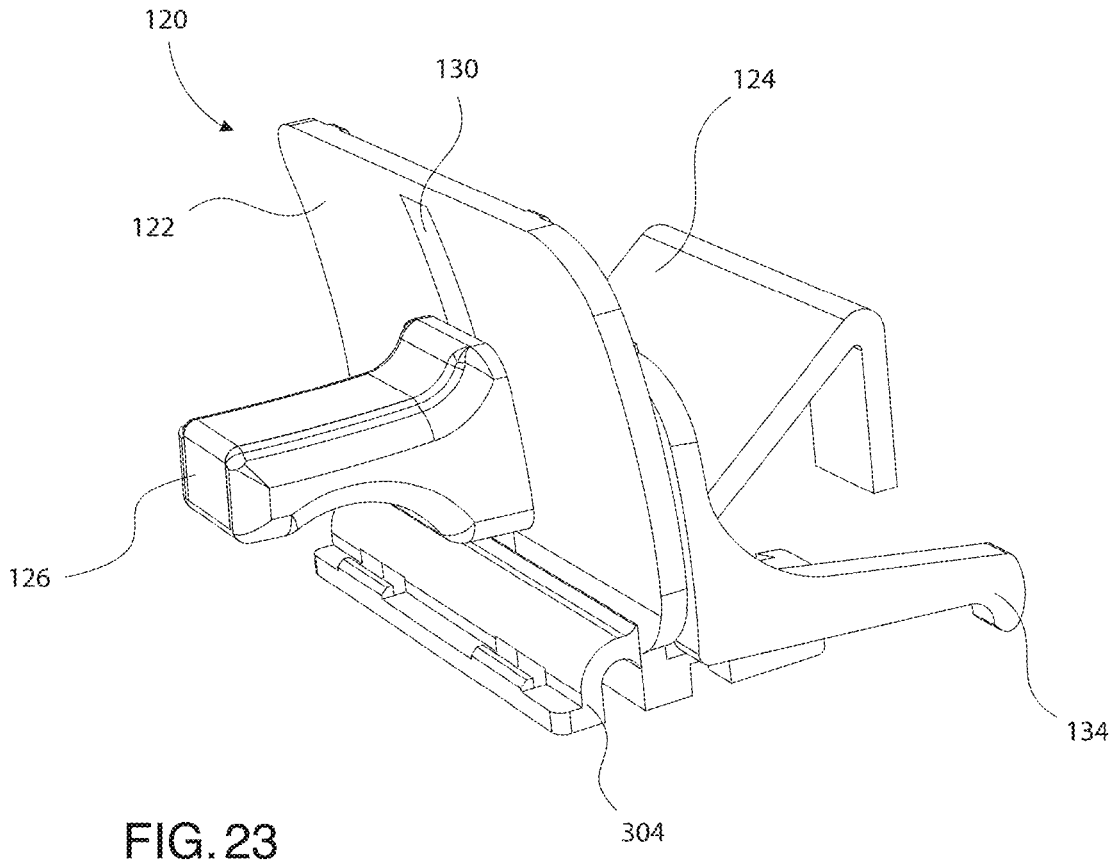
FIG. 23 illustrates a perspective view of a lever actuator of a product holder in an embodiment.
Figure 24:
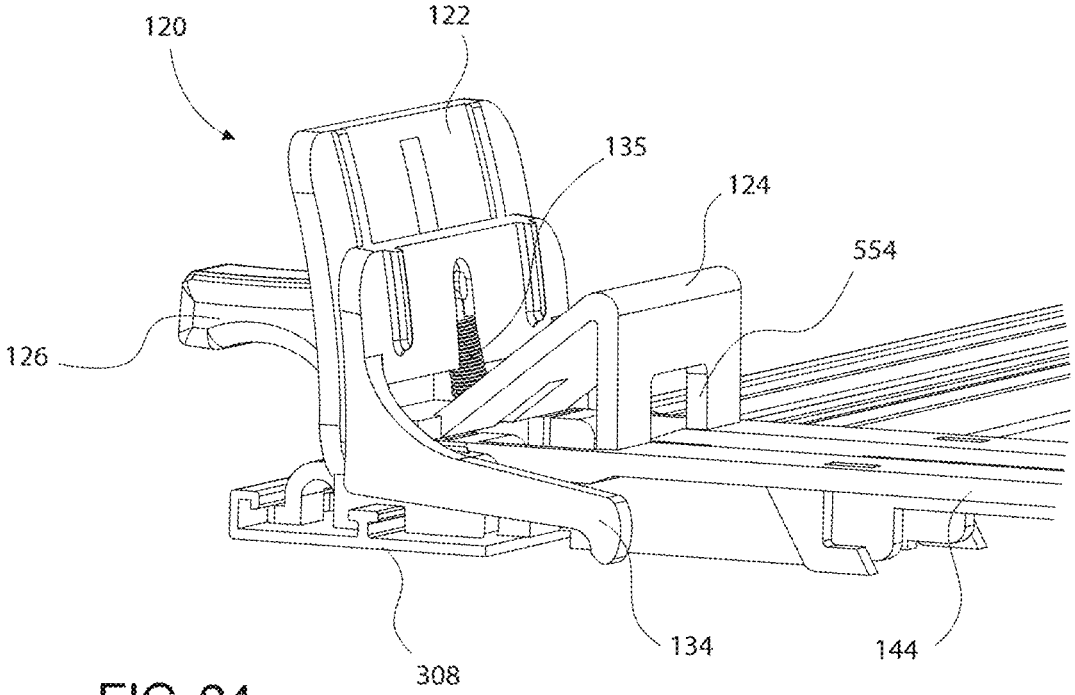
FIG. 24 illustrates a perspective view of a lever actuator of a product holder connected to a door hinge locking track in an embodiment.

FIGS. 4, 23 and 24 shows a handle 126 may be affixed to a lever body 128 which may transverse a slot or lever track 130 (hereinafter "lever track 130") formed in the dispenser body 122. As a result, the handle 126 may be constrained to move in the direction of the lever track 130. In embodiments, the handle 126 is movable a vertical or substantially vertical direction within the lever track 130. A rectangular slot traveller 132 (hereinafter "traveller 132") may be integrated with the lever body 128 which may maintain the orientation of the lever body 128 as the traveller 132 may move and/or slide along or within the lever track 130. The handle 126 may be connected with the lever body 128 via the traveller 132. The handle 126 and dispenser body 122 may have instructions, advertising and/or printed material(s) displayed thereon.

One or more lever forks 134 may be connected, attached and/or affixed to or integrated with the lever body 128. The lever forks 134 may be oriented towards and/or extend inwardly with respect to the rear of the shelf frame 10 when the level body 128 is located and/or positioned within the shelf frame 10. Additionally, the lever forks 134 may be aligned on either side of the ramp 124 of the dispenser body 122 when the dispenser body 122 may be connected and/or attached to the lever body 128 and/or the handle 126. The lever forks 134 extend outward with respect to the ramp 124 so that the lever forks 134 may engage, move, raise and/or lift a single product 160 upward beyond the ramp 124 when the handle 126 may be activated, lifted and/or raised. When activating, lifting and/or raising the handle 126, the lever forks 132 move from a rest position to a raised position to contact one of the products 160 located within the shelf frame 10. An actuator return means 135 (as shown in FIG. 24) may be provided and may be configured to exert a returning force on the traveller 132, the handle 126 and/or lever body 128 such that the handle 126 and/or the level forks 134 move downward and return to the rest position after the handle 126 is no longer activated or deactivated. In the rest position, the lever forks 134 may rest below the surface of a track 144 (shown in FIG. 3) so that retail items may slide up and/or forward towards the front-side 11 of the shelf frame 10 against the ramp 124 without interference with the lever forks 134. The actuator return means 135 may be, for example, a spring, an elastic element and/or the like. The present disclosure should not be deemed as limited to a specific element of the actuator return means 135.

Sound arms 136 may be provide with the lever body 128 so that as the lever handle 126 may be activated, a mechanical and/or audio sound may be generated as the sound arms 136 may transverse one or more sound channels 138 formed within the dispenser body 122 as shown in FIG. 4. The sound arms 136 may be made of, for example, semi-rigid plastic or a substantially rigid plastic with at least one pin that may engage one or more teeth in the one or more sound channels 138. The rigidity of the plastic may bias the pin of the sound arms 136 against one or more teeth of the sound channel 138 while allowing the sound arm 136 to bend as the pin is drawn by the handle 126 over the one or more teeth. As a result, an audio sound may be produced and/or generated by pin and/or the one or more teeth as the handle 126 is activated, moved, raised and/or lift upward.

Figure 3:
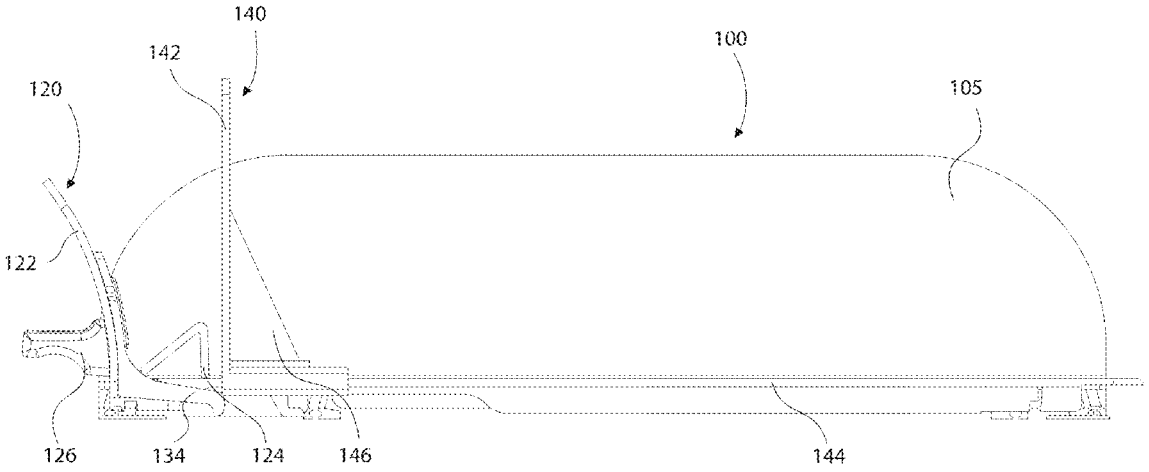
FIG. 3 illustrates a side view of a product holder in an embodiment.

FIGS. 3 and 21 show a pusher 140 that may be associated with each lever actuator 120 in each of the holder 100. A pusher paddle 142 on the track 144 and/or pusher plate aligned with the holder 100 may be biased and/or forced forward with respect to the front-side 11 of the shelf frame 10 by a spring or other known biasing mechanism (not shown in the drawings), such as, for example, a spring. The pusher paddle 142 may be mounted and secured to the track 144 using a mount 146. During loading of the shelf frame 10, the pusher 140 may be retracted towards the rear of the shelf frame 10 and additional and/or new products 160 may placed and/or loaded onto the holder 100 between the lever actuator 120 and the pusher 140 on the track 144. The pusher 140 may then be released and the biasing mechanism may apply the pusher 140 forwards or towards the front-side 11 of the shelf frame 10 and the lever actuator 120. In embodiments, the pusher 140 may automatically retract rearwards when the shelf frame 10 may be moved to a loading position as shown in FIGS. 8 and 9 and may automatically move forward and towards the front-side 11 of the shelf frame 10 when the shelf frame 10 is moved from the loading position to the closed position. The biasing mechanism associated with the pusher 140, the pusher paddle 142 and/or the track 144 may be any biasing mechanism as known to one of ordinary skill in the art.

FIG. 21 shows an embodiment of the pusher paddle 142 having at least an angled portion 143 of the pusher paddle 142 which may be positioned in a forward angle with respect to the front of the shelf frame 10. In other embodiments, all of the pusher paddle 142 may be positioned in the forward angle with respect to the front of the shelf frame 10. As a result, the forward angle of the pusher paddle 142 may help to ensure and/or to facilitate correct positioning of products 160 in and/or on the pusher 140 and/or the holder 100. The correct positioning of products 160 may ensure and/or facilitate correct dispensing of the products 160 via the lever actuator 120 from the shelf frame 10. Moreover, the correct positioning of products 160 may prevent and/or substantially prevent the products 160 from becoming jammed, during dispensing, between the blocker panel 32 and the lever actuator 120.

The retail items 160 may be biased towards the lever actuator 120 by the pusher 140 which may be stopped by the product stop ramp 124 as shown in FIGS. 5A and 21. With reference to FIG. 5B, when the handle 126 may be activated, raised and/or lifted, the lever forks 134 may be lifted and/or moved upward, which may lift and/or raise a single product 160 over the ramp 124. As shown in FIG. 5C, when the product 160 is lifted and/or raised by the forks 134 over the ramp 124, the product 160 may rest against the dispenser body 122 and/or the front panel 26. Remaining products 160 located within the holder 100 may remain stopped by and/or located behind the ramp 124 to prevent access to the remaining products 160 as shown in FIGS. 5D and 5E. Returning force from spring 135 and/or deactivating, lowering and/or releasing the handle 126 may return and/or lower the lever forks 134 to the rest position.

With reference to FIGS. 5D and 5E, when the front panel 26 is opened, such as by moving and/or pulling the handle 28, the product 160 which may be resting on the dispenser body 122 and/or the front panel 26 may be accessed, dispensed and/or removed from the shelf frame 10 through the opening formed between the shelf frame 10 and the front panel 26 and/or the blocker panel 32 when the front panel 26 is located in the open position and/or the blocker panel 32 is located in the blocked position. The remaining products 160 located on the holder 100 may be securely maintained behind the ramp 124 and may be inaccessible due to the blocker panel 32. As a result, the blocker panel 32 prevents or substantially limits access to the remaining products 160 behind the blocker panel 32 and the ramp 124 thereby securely storing the remaining products 160 and/or preventing and/or deterring theft of the remaining products 160 when the front panel 26 is located in the opening position and/or the blocker panel 32 is located in the blocker position.

Figure 10A:
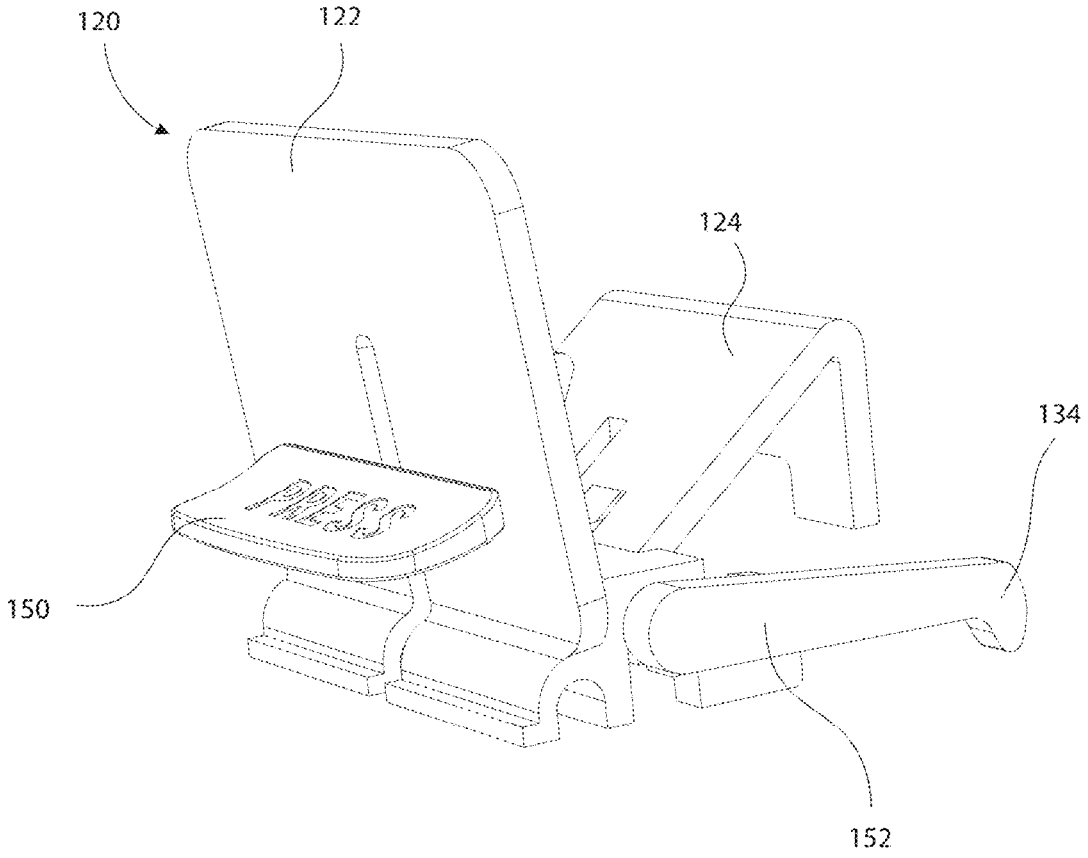
FIG. 10A illustrates a perspective view of a lever actuator of a product holder in an embodiment.
Figure 10B:
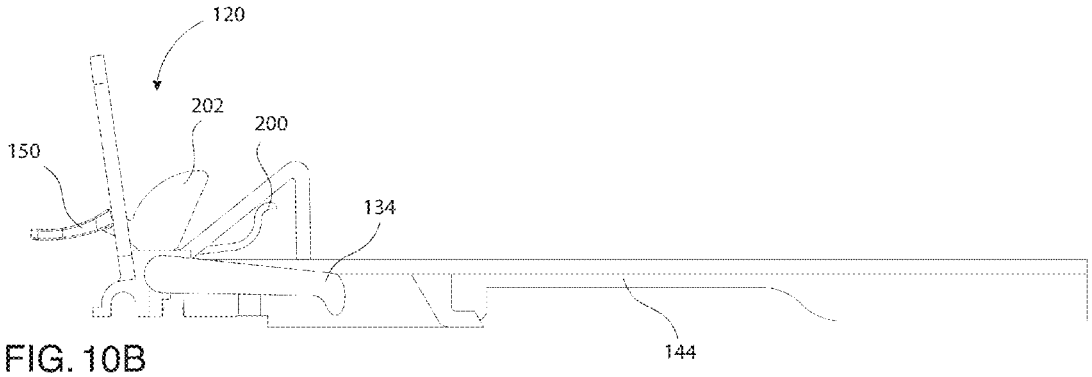
FIGS. 10B and 10C illustrate side views of a lever actuator on a track of a product holder in an embodiment.
Figure 10C:
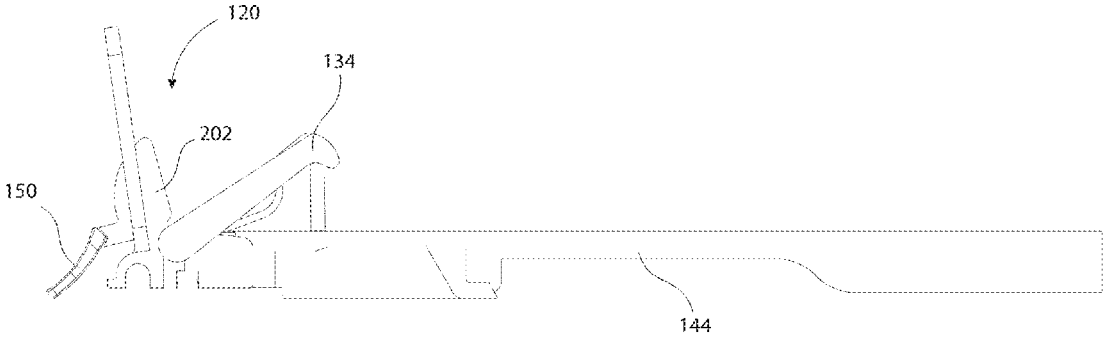

In an embodiment, the lever actuator 120 may have a lever handle 150 and paddle lever 152 which may be fixed to each other at a pivot point as shown in FIGS. 10A-10C. The paddle lever 152 may have the lever forks 134 that may move pass and/or move above the ramp 124 to engage, lift and/or raise a single product 160. A consumer may move, press and/or activate the lever actuator 120 by pushing the lever handle 150 downward which may raise the lever forks 134 and/or may lift the single product 160 over the ramp 124. In embodiments, a sound arm may be attached to the dispenser body 122 which may engage a series of teeth affixed to the lever handle 150, the paddle lever 152 may pivot such that the lever handle 150 may be activated, and a mechanical and/or audio sound may be produced and/or generated by the sound arm and/or teeth. The lever actuator 120 may be located on the track 144 in an unengaged position as shown in FIG. 10B. When the lever actuator 120 may be moved, pressed, and/or engaged, the lever forks 134 may pivot upward and/or move above the ramp 124 as shown in FIG. 10C.

As shown in FIGS. 10B and 10C, the lever actuator 120 may have and/or may include a return spring 200 for returning the lever actuator 120 to a start position or the unengaged and/or rest position from the engaged position after the lever actuator 120 may be pressed, moved and/or activated. As a result, the return spring 200 may return or reset the lever actuator 120 to the unengaged and/or rest position after the lever actuator 120 may be pressed and/or after the paddle lever 152 and/or the lever forks 134 are engaged. As a result, the lever forks 134 may be moved and/or forced downward to the rest position by the return spring 200. Further, the lever actuator 120 may have and/or may include a product cam 202 which may be configured to provide additional security and/or single press functionality for the lever actuator 120. For example, when the lever handle 150 may be pressed, the single product 160 for dispensing may jump, move, transverse and/or be forced over the ramp 124 and rest against the product cam 202 and/or the front panel 26. As a result, the single product 160 for dispensing and the product cam 202 may retaining the lever actuator 120 in a downward and/or engaged position whereby the lever forks 134 may be located in an upward or engaged position which may prevent a second additional product 160 from being dispensed during a single activation of the lever actuator 120. Once the single product 160 for dispensing may be removed via the opening formed between the front panel 26, the blocker panel 32 and/or the shelf frame 10 when the front panel 26 may be located in the open position and/or the blocker panel 32 may be located in the blocked position, the product cam 202 may be released and/or the return spring 200 may move or force the lever actuator 120 back to the unengaged and/or rest position.

In an embodiment, the shelf frame 10 may be mounted on horizontal or substantially horizontal tracks 170 (hereinafter "tracks 170"), or may include horizontal or substantially horizontal tracks, so that the shelf frame 10, including the holders 100, may be withdrawn, moved and/or pulled outward from, for example, the uprights 21 as shown in FIGS. 6, 8, 9 and 18-20. The fixed frame portion 20 (shown in FIGS. 6 and 22) may remain attached, connected and/or secured to the shelving unit 23 and/or the uprights 21, via the fastening means 18. As a result, other products 160 may be added to the holders 100 easily and/or in a convenient and timely manner, especially if the shelf frame 10 may be mounted below other shelf frames 10. Additional, new products 160 may be added to the holders 100 through and opening 301 at the top side of the shelf frame 10 between the plate 22 and/or top panels 24 as shown in FIGS. 20 and 21. The top panel 24 may be connected, attached and/or mounted to the fixed frame portion 20 as shown in FIG. 8.

The tracks 170 may include and/or may have one or more stops (not shown) to prevent the shelf frame 10 from being withdrawn completely out of the fixed frame portion 20 as shown in FIG. 6. In embodiments, the one or more stops may position the shelf frame 10 at the appropriate position when slide back in.

Figure 15:
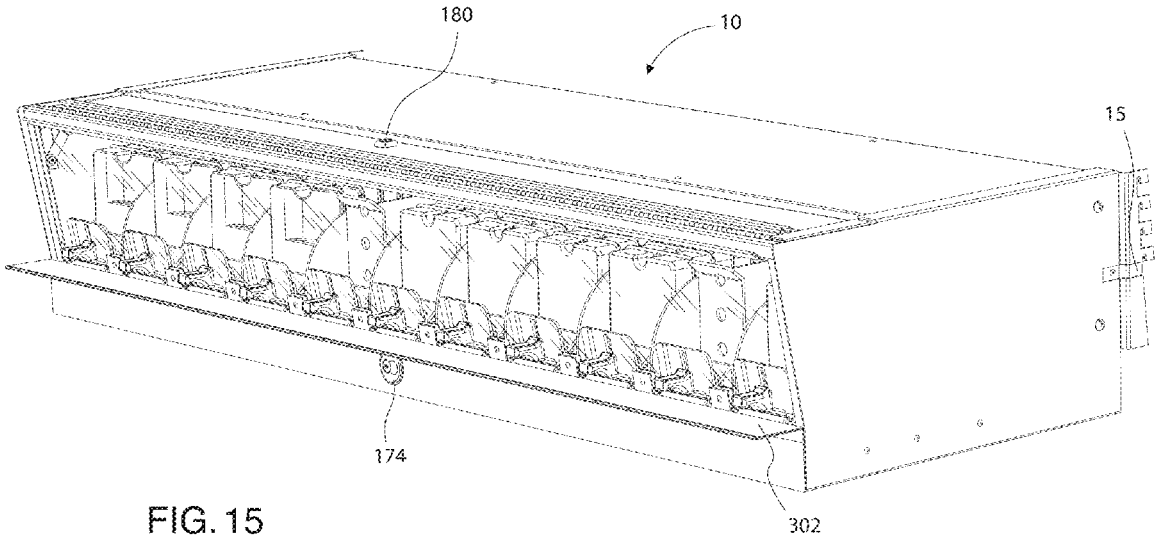
FIG. 15 illustrates a perspective view of a shelf system with a front panel located in an open position in an embodiment.

The drawer lock mechanism 174 may secure the shelf frame 10 to its mounts so that only authorized personnel may slide, move, open the shelf frame 10 to the open and/or loading position for reloading the products 160 as shown in FIGS. 6, 15 and 21. A key usable with the lock mechanism 174 may operate at least one arm (not shown in the drawings) that may engage at least one portion of the fixed frame portion 20 of the shelf frame 10 so that the shelf frame 10 may not be slid, withdrawn and/or moved outwardly to the open and/or loading position. When the key may release and/or unlock the drawer lock mechanism 174, the at least one arm may disengage the at least one portion of the fixed frame portion 20 such that the shelf frame 10 may be moved to the open and/or loading position.

In an embodiment, the pusher panel 142 may engage with pusher hooks 172 fixed to a lower cross support on the shelf frame 10 when the shelf frame 10 may be withdrawn and/or moved outwardly to the open and/or loading position. When the shelf frame 10 may be withdrawn from the uprights 21 via the tracks 170, the pusher hooks 172 may retain the pusher panel 142 and/or the pusher 140 may be refracted from the lever actuator 120 for creating an open space (indicated as "A" in FIG. 6) between the pusher panel 142 and lever actuator 120 so that additional and/or new products 160 may be easily reloaded, restocked and/or stored without requiring each pusher 140 to be retracted manually during reloading processes. As the shelf frame 10 may slide and/or move outwardly to the open and/or loading position, the pusher panel 142 for each holder 100 may be withdrawn simultaneously together. In embodiments, the pusher panel 142 of each holder may be withdrawn separately and/or independently with respect to each other. When the shelf frame 10 may be slide back to its closed position, spring force may be applied to the pusher panel 142 which may move the pusher panel 142 towards the lever actuator 120. In an embodiment, instead of the pusher hooks 172, connectors, such as, for example, cables may connect and/or attach the pusher hooks 172 to mounting points on a back side of the shelf frame 10.

In an embodiment, the ramp 124 may comprise two or more product stop ramps which may located and/or positioned adjacent to each other. Lever forks 134 may move and/or traverse between one or more ramps 124 through suitable groves or openings.

With reference to FIGS. 6, 11, 14, 15 and 21, the shelf frame 10 may include one or more night locks 180 which may be connected and/or attached to and/or fixed in the plate 22, the top panel 24 and/or the shelf frame 10. The night lock 180 may be activated and/or locked with a key or other locking mechanism and/or may rotate from an engaged position (as shown in FIG. 11) to a released position (as shown in FIG. 6). The night locks 180 may include and/or may be connected, attached and/or fixed to a night lock arm 182 which may rotate when activated and/or deactivated by the key or other locking mechanism. In an activated, locked and/or engaged position, the night lock arm 182 may block the blocker panel 32 from moving, rotating and/or pivoting from the upward position to the blocked position. Since the blocker panel 32 may be connected, attached and/or linked to the front panel 26, the front panel 26 may also be locked in the closed position when the night lock arm 182 may be in the locked, activated and/or engaged position. As a result, by locking and/or engaging the night lock 180, the front panel 26 may not be opened so that the products 160 within the shelf frame 10 may not be dispensed and/or removed from the shelf frame 10. The night lock 180 may be activated when the market place and/or the retail establishment may be closed for business to prevent employees from removing the products 160 from the shelf frame 10 without authorization.

With reference to FIGS. 12A to 12D and 13A to 13D, in embodiments, an activator 200 may be a knob that may turn a cam 202 to move, lift and/or dispense the products 160. The activator 200 may include a ratchet so that an audio sound may be generated and/or produced as the activator 200 may be manually moved, turned and/or rotated. As the activator may be moved, turned and/or rotated, the cam 202 may moved and/or lift a single product 160 upwardly so that the single product 160 may be accessed and/or dispensed from the opening formed when the front panel 26 is located in the open position and/or the blocker panel 32 is located in the blocked position. A spring (not shown in the drawings) may return the activator 200 and/or the cam 202 to the rest position after an activation is completed. With reference to FIGS. 12A to 12D, the dispenser body 122 may be curved or substantially curved. With reference to FIGS. 13A to 13D, the dispenser body 122 may be flat or substantially.

In embodiments, the front panel 26 may cover more than half or more than three-quarters of the front-side 11 of the shelf frame 10 as shown in FIG. 14. Additionally, for securely displaying the products 160 stored within the shelf frame 10, the window 29 may be transparent and may cover more than half or more three-quarters of the front-side of the shelf frame 10 as shown in FIGS. 14-17. As a result, a consumer may easily and conveniently view the products 160 which may be securely stored, displayed and dispensed from the shelf frame 10.

In embodiments, the front panel 26 may have at least one window and/or opening 303 (hereinafter "the opening 303") which may be formed and/or provided at, near and/or adjacent to the bottom edge of the front panel 26 as shown in FIGS. 16-18 and 25. The opening 303 of the front panel 26 may be sized, configured and/or adapted to receive at least one portion of the level actuator 120. For example, the opening 303 may be sized, configured and/or adapted to receive the handle 126 of the level actuator 120. As a result, at least one portion of the level actuator 120 may extend outwardly with respect to the front panel 26 when the front panel 26 is located in the open and/or closed positions. Moreover, the at least one portion of the level actuator 120 may extend outwardly with respect to the front side 11 of the shelf frame 10 via the opening 303 of the front panel 26.

As shown in FIGS. 14-22, the hinging mechanism 25 of the front panel 26 may be located at the bottom edge 27 of the front panel and may be pivotably and/or rotatably connected, attached, affixed and/or coupled to a door hinge clip 304 of the level actuator 120 (as shown in FIGS. 23 and 24. The door hinge clip 304 may be located and/or positioned below and/or adjacent to the dispenser body 122 and/or the handle 126. Moreover, the door hinge clip 304 may extend outwardly from the dispenser body 122 and/or below the handle 126. The door hinge clip 304 may be connected, attached and/or affixed to and/or integral with the level actuator 120, the dispenser body 122, the ramp 124 and/or the level forks 134. When the hinging mechanism 25 of the front panel 26 may be connected, attached and/or affixed to the door hinge clip 304 of the level actuator 120, the front panel 26 and/or at least one portion of the level actuator 120 may move, pivot and/or rotate at a pivot point 306 that is located below the handle 126 of the level actuator 120 as shown in FIG. 21. As a result, the front panel 26 and/or at least one portion of the level actuator 120 may be move, pivot and/or rotate to the closed position (shown in FIGS. 14, 15, 17, 18, 21) and/or to the open position (shown in FIG. 16) via the hinging mechanism 25, the door hinge clip 304 and/or the pivot point 306. The opening 303 of the front panel 26 may be sized, configured and/or adapted to allow, permit and/or maintain the at least one portion of the level actuator 120 therein when the front panel 26 is located in the closed position, in the open position and/or in an intermediate position located between the closed and opened positions as shown in FIGS. 14-20, 25 and 26. For example, the at least one portion of the level actuator 120, such as, for example, the handle 126 may remain within and/or may be maintained within the opening 303 of the front panel 26 when the front panel 26 is located in one or more of the closed position, the open position and the intermediate position.

In an embodiment, a door hinge locking track 308 may be provided as shown in FIG. 24. The door hinge locking track 308 may be configured, sized and/or adapted to connect, attach and/or affix to the door hinge clip 304 and/or the level actuator for each holder 100 located and/or positioned within the shelf frame 10. Moreover, the door hinge locking track may extend across at least a portion of a width of the shelf frame 10 and may be connected, attached and/or affixed to the front panel 26. When the front panel 26 is connected, attached and/or affixed to the door hinge locking track 308. The door hinge clip 304 and/or the door hinge locking track 308 may be made of a material, such as, for example, the metal material and/or the hard plastic material. The present disclosure should not be deemed as limited to a specific embodiment of the material of the door hinge clip 304 and/or the door hinge locking track 308.

The shelf frame 10 may have a movable cover 302 (hereinafter "cover 302") which may be located at a bottom portion of the front-side 11 of the shelf frame 10. The cover 302 may be connected, attached and/or affixed to the shelf frame 10, the front panel 26, the level actuator 120 and/or the inside frame 300 as shown in FIG. 22. The cover 302 may protect and/or cover the drawer locking mechanism 174 to prevent tampering with the drawer locking mechanism 174. The cover may be moved, lifted and/or raised to provide access to the drawer locking mechanism 174 as shown in FIG. 15. The cover 302 may have a hinging assembly (not shown in the drawings) located and/or positioned at either a top end or bottom end of the cover 302. The hinging assembly of the cover 302 may movably connect, attach and/or affix the cover 302 to the shelf frame 10, the front panel 26, the level actuator 120 and/or the inside frame 300. In embodiments, the cover 302 may be made of a material, such as, for example, metal material, a hard plastic material and a flexible soft plastic material. Moreover, the cover 302 may be or may provide a clear plastic holder to display and/or affix printed indicia, such as, for example, at least one of a graphic, an instruction, a price ticket, an advertisement, a logo, a trademark and/or the like. The present disclosure should not be deemed as limited to a specific embodiment of the material of the cover 302 and/or the printed indicia which may be displayed and/or affixed by the cover 302.

FIG. 16 illustrates the shelf frame 10 dispensing a single product 160 which may be accessible by a consumer and/or employee via the opening formed between the front panel 26, the blocker panel 32 and the shelf frame 10 when the front panel 26 is located in the open position and the blocker panel 32 is located in the blocked position. FIG. 17 illustrates the shelf frame 10 securely displaying the products 160 with eleven product facings via the window 29. FIG. 18 illustrates the shelf frame 10 located in the open and/or loading position such that additional and/or new products 160 may be inserted and/or stored within the interior 101 of the shelf frame 10 and/or on the holder 100 within the shelf frame 10.

FIG. 22 shows the shelf frame 10, in an embodiment, having the fixed frame portion 20, the inside frame 300, the top panel 24, the front panel 26, the blocker panel 32 and the fastening means 18. The structural plate may be integrally formed with inside frame 300 and the linkage 30 may be connected, attached and/or welded to the blocker panel 32. The front panel 26 may have the window 29 and the bottom edge 27 may be configured to be rotatably and/or pivotably connected, attached and/or affixed the door hinge clip 304 and/or the door hinge locking track 308. The fixed frame portion 20, the inside frame 300, the front panel 26, the blocker panel 32 and the fastening means 18 may be configured, sized and/or adapted to be assembled to form the shelf frame 10.

Figure 27:
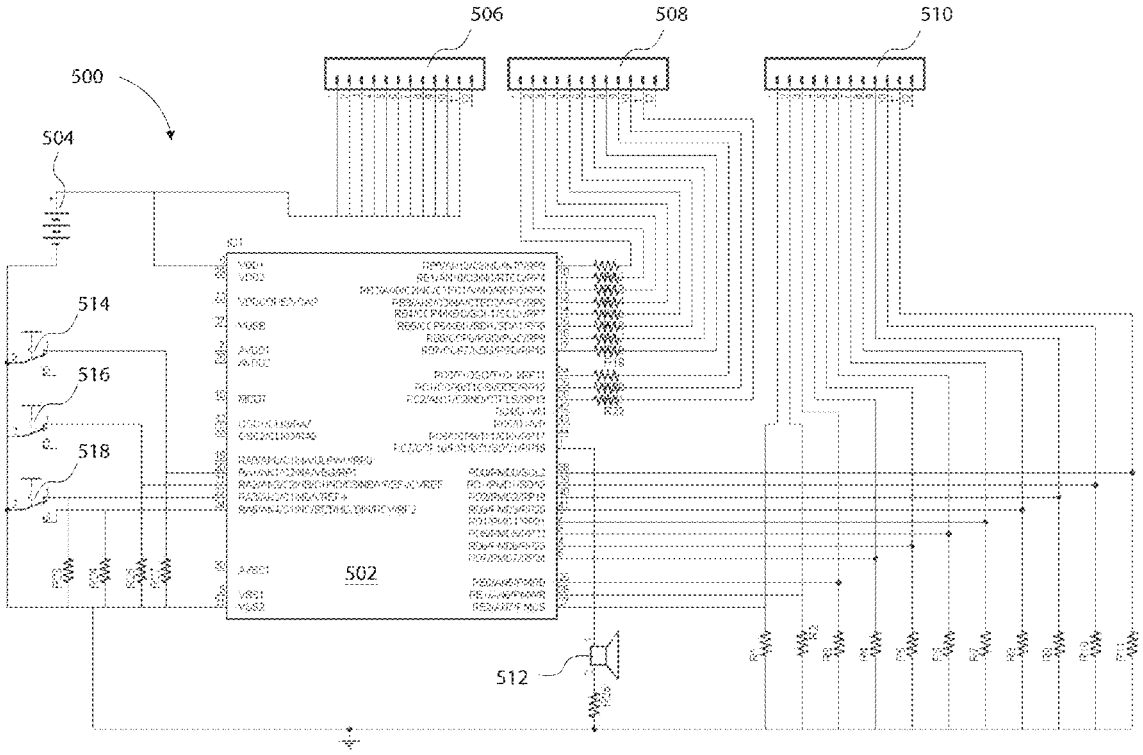
FIG. 27 illustrates a schematic diagram of an electronic alert system electrically connectable to the shelf system in an embodiment.

In embodiments, the front panel 26, the blocker panel 32, the handle 126, the drawer locking mechanism 174 and/or the one or more night locks 180 may be connected to, coupled to and/or associated with at least one electronic alert system 500 (hereinafter "alert system 500") as shown in FIG. 27. The alert system 500 may electronically track the products 160 which may be dispensed from the shelf frame 10. Moreover, the alert system may provide and/or produce various audible and/or visual alerts to one or more customers and/or one or more store attendants or employees which may be located locally, adjacent to and/or remote with respect to the shelf frame 10.

The alert system 500 may have an integrated circuit 502 (hereinafter "IC 502") which may be electrically connected to and/or in electrical communication with at least one power source 504 (hereinafter "power source 504"), at least one actuator 506 (hereinafter "actuator 506"), at least one electronic visual alert system 508 (hereinafter "visual alert system 508"), at least one switch 510 (hereinafter "switch 510) and/or at least one electronic audio alert system 512 (hereinafter "audio alert system 512"). The alert system 500 and/or the IC 502 may be customizable and configurable as known to one of ordinary skill in the art. The IC 502 may, for example, be electrically connected to and/or in communication with a reset switch 514, a door switch 516 and/or a timer switch 518. The IC 502 may be electrically connected to and/or in communication with the power source 504, the actuator 506, the visual alert system 508, the switch 510, the audio alert system 512, the reset switch 514, the door switch 516 and/or the timer switch 518 by any means as known to one of ordinary skill in the art.

Figure 28:
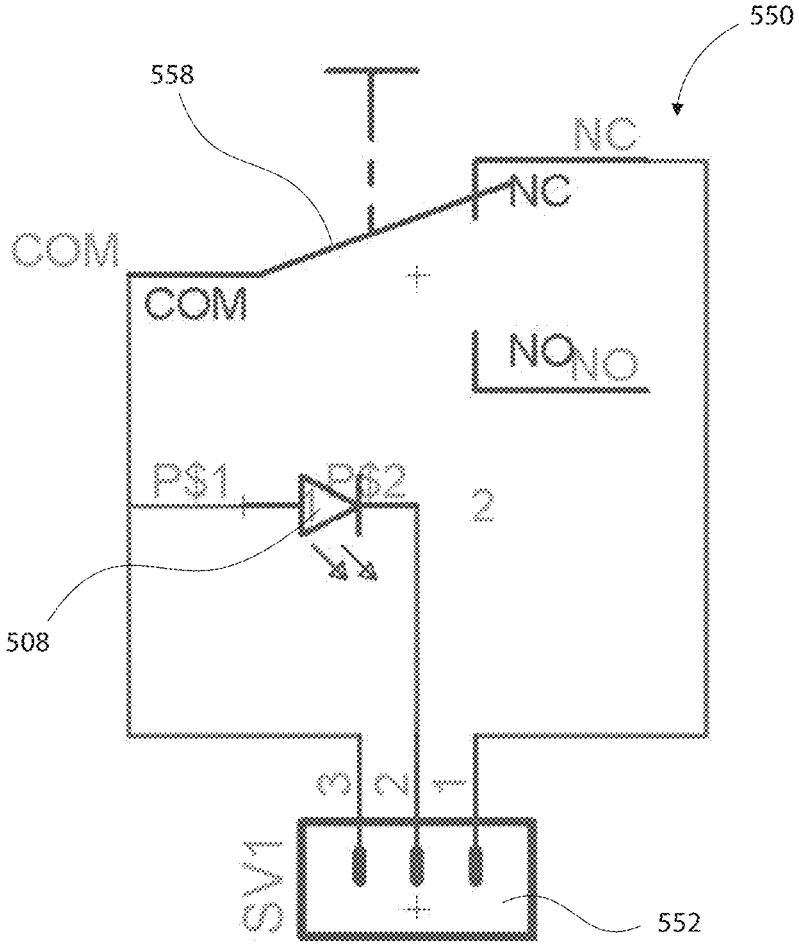
FIG. 28 illustrates a schematic diagram of a product sensor electrically connectable to the shelf system in an embodiment.

In an embodiment, the alert system 500 and/or IC 502 may be electrically connected to and/or in communication with at least one product sensor 550 (hereinafter "the product sensor 550") via a connector 552 of the product sensor 550 as shown in FIG. 28. The actuator 506, the visual alert system 508, the switch 510 and/or the audio alert system 512 may be included in and/or incorporated into the product sensor 550. In an embodiment, the product sensor 550 may have at least one switch or sensor 558 (hereinafter "sensor 558"), which may be, for example, a tactile switch, and the visual alert system 508, which may be, for example, a light emitting diode (hereinafter "LED"). The visual alert system 508 may be adapted and/or configured to emit one or more colours when the visual alert system 508 may be activated and/or actuated by the IC 502. The sensor 558 may be and/or may include, for example, one or more motion sensors, one or more accelerometers, one or more fluctuations in an electric current, one or more magnetic switches and/or one or more tactile switches. The product sensor 550 may be electrically connected to and/or in communication with the alert system 500 and/or the IC 502 by any means as known to one of ordinary skill in the art.

The product sensor 550 may be located at a position within the interior 101 of the shelf frame 10 or outside of the shelf frame 10. In embodiments more than one product sensor 550 may be provided, which may be located at positions inside and/or outside the interior 101 of the self frame 10. In an embodiment, the ramp 125 of the level actuator 120 may provide a holder 554 for the product sensor 550 as shown in FIG. 24. The holder 554 may be formed in the ramp 125 and may be sized, configured and/or adapted to receive, house and/or store the product sensor 550. As a result, the product sensor 550 may be located and/or positioned adjacent to one or more products 160 which may be located within the interior 101 of the shelf frame 10. The product sensor 550 may be located and/or positioned the inside frame 300, the front panel 26, the dividers 105, the holder 100, the dispenser body 122, the lever forks 134, the handle 28 and/or the handle 126. It should be understood that the present disclosure is not deemed to be limited to a specific location of the product sensor 550 on and/or within the shelf frame 10.

Figure 29:
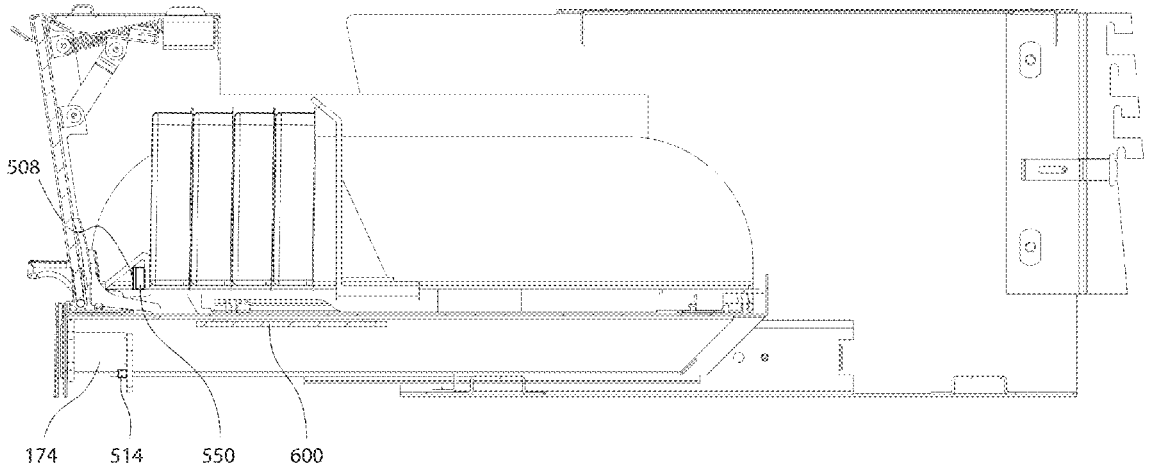
FIG. 29 illustrates a cross-sectional view of a shelf system having a controller board and product sensor in an embodiment.

In an embodiment, the shelf frame 10 may have a controller board 600 mounted thereon and/or located at a position within the interior 101 of the shelf frame 10 as shown in FIG. 29. The alert system 500, the IC 502, the power source 504, the actuator 506, the visual alert system 508, the switch 510, the audio alert system 512, the reset switch 514, the door switch 516 and/or the timer switch 518 may be provided on the controller board 600. The product sensor 550 may be positioned and/or located within the holder 554 of ramp 120 and may provide the sensor 558, the visual alert system 508 and/or the audio alert system 512. Further, the reset switch 514 may be located and/or position adjacent or substantially adjacent to the drawer lock mechanism 174. The controller board 600 may have the IC 502 which may be electrically connected to and/or in communication with the product sensor 550, the visual alert system 508 and/or the reset switch 514. The controller board 600 may be expandable via one or more empty ports which may provide and/or faciliate the addition of one or more additional features at a subsequent time. The reset switch 514 may be actuated by the drawer lock mechanism 174 when, for example, the drawer lock mechanism 174 may be moved to a lock position or an unlocked position.

For example, the sensor 558, such as, for example, a tactile switch may be installed in the holder 554 of the ramp 124 of the dispenser body 122 which may be positioned and/or located within the interior 101 of the shelf frame 10. The visual alert system 508 may be, for example, an LED alert light which may be located and/or positioned on and/or within the dispenser body 122. The sensor 558 and/or the visual alert system 508 may be connected to controller board 600 which may be, for example, a micro-controller located on an underside of the inside frame 300. When products 160 are loaded into the holder, the pusher paddle 142 may push the products 160 forward against the ramp 124 of the dispenser body 122. The sensor 558 which may be integrated into the ramp 124 may be activated and/or may register that the products 160 may be present.

When a customer may dispense a product, a change may be registered in the holder 100 by the sensor 558 and/or the product sensor 550. The registered change may activate the visual alert system 508 in the dispenser body 122 which may act as a visual warning to the customer that the actions of the customer are being tracked. An audible sound, alarm or message may be emitted and/or generated by audio alert system 512 based on the registered change detected by the sensor 558 and/or the product sensor 550. This registration process may repeat for each and/or every product 160 which may be dispensed from the shelf frame 10.

If a pre-determined number of the products 160 may be dispensed, without opening the front panel 26, whereby the sensor 558 may be positioned, one or more audible signals or alerts may be emitted and/or generated the audio alert system 512 and/or one or more light signals or alarms may be emitted and/or generated by the visual alert system 508. The audible and/or visual signals or alerts may be set to various time durations, selectable via the timer switch 518 on the controller board 600. For example, if the pre-determined number may be three, when any three products 160 may be dispensed, without opening the front panel 26, on the dispensing of the third product 160, at least one audible and/or visual alarm may be activated for the set amount of time.

For example, if one product 160 or a number of products 160 (less than the pre-determined number required for activating the alarm) may be dispensed, a chime or audible signal or alarm may be activated only when the front panel 26 may be opened to retrieve the product 160. The chime or audible signal or alarm may continue to be emitted or produced while the front panel 26 may be located in the open position. However, for example, if this pattern may be repeated more than a pre-determined number (for example, three times) the chime or audible signal or alarm may be activated for the period of time set on the controller. It is also possible for the chime or audible signal or alarm to remain activated indefinitely until deactivated by, for example, a store employee activating the reset switch 518 via the drawer lock mechanism 174. The chime or audible signal alarm may be deactivated when the drawer lock mechanism 174 may be moved to an unlocked position.

A pattern or sequence of events which may be required to trigger the chime or audible signal or alarm may be customized to fit the level of security required by the customer or required for a specific location of the shelf frame 10. The controller board 600 may, for example, keep detect, track and/or log of the total number of actuations of the audible signal and/or alarm or the number of products 160 dispensed from the shelf frame 10. Information relating to and/or associated with the total number of actuations of the audible signal or alarm and/or the number of products 160 dispensed from the shelf frame 10 may be displayed on a visual display device, such as, for example, a liquid crystal diode display which may be located on the front side 11 in the interior 101 of the shelf frame or which may be hidden from plain view underneath, for example the cover 302. In embodiment, a store employee may connect to and/or plug in a portable digital device into a port (not shown in the drawings) on the front side 11 of the shelf frame 10 to access, obtain and/or display the information. The port may be electronically connected to and/or in communication the controller board 600 and/or the IC 502 of the alarm system 500.

In an embodiment, there may be an alert light or beacon (not shown in the drawings) located on the top of the aisle gondola 401 which may be configured or adapted to visually alert a store employee of potential misuse or theft. The alert light or beacon may be electronically connected to and/or in communication with the controller board 600, the IC 502 and/or the alarm system 500. As a result, the alert light or beacon may be controlled, activated and/or deactivated by the controller board 600, the IC 502 and/or the alarm system 500. Moreover, the alert light or beacon may be reset by, for example, unlocking the drawer lock mechanism 174.

There may be, for example, a wireless employee alert system (not shown in the drawings). The wireless employee alert system may provide one or more wireless devices which may be wirelessly connected to and/or in wireless communication with the controller board 600, the IC 502 and/or the alarm system 500. The one or more wireless devices may be portable wireless devices, such as, for example, a smart phone, a digital tablet, a cellular phone, a laptop computer, a text messaging device. In embodiments, the wireless device may be a stationary computer and/or the like. The one or more wireless devices may be configured and/or adapted to emit and/or generate one or more alert signals when wirelessly activated by the controller board 600, the IC 502 and/or the alarm system 500. The present disclosure should not be deemed as limited to the specific embodiment of the one or more wireless devices.

If, for example, the controller board 600, the IC 502 and/or the alarm system 500 activates one or more alarm signals, one or more wireless devices which may be accessible by one or more store employees may be activated and may provide the store the one or more employees with the one or more alarm signals, via the one or more wireless devices, which may signal that one or more alarms may have been triggered or activated by the controller board 600, the IC 502 and/or the alarm system 500.

In embodiments, alarm system 500 may be configured and/or adapted to trigger, generate and/or activate one or more audible and/or visual alarms when the shelf frame 10 may have been tampered with and/or damaged. For example, when the front panel 26 may be located in the open position and/or the blocker panel 32 may be located in blocked position, one or more audible and/or visual alarms may be triggered, generated and/or activated. Additionally, the one or more audible and/or visual alarms may be triggered, generated and/or activated when the drawer locking mechanism 174 and/or the one or more night locks 180 may be engaged and/or activated and the front panel 26 and/or blocker panel 32 may be tampered with and/or damaged. In an embodiment, the power source 504 may be, for example, a battery which may be integrated with the shelf frame 10 or may be situated remotely with respect to the shelf frame 10. As a result, any use of the shelf frame 10 to obtain and/or dispense the products 160 may be associated or monitored with and/or detected by the alarm system 500 which may reduce occurrences of an individual holding the front panel 26 open and obtaining more than one or multiple products 160. An access panel and/or opening for the alarm system 500 or one or more components of the alarm system 500 may be located on the plate 22 to facilitate, for example, replacing a battery associated with the power source 504.

Figure 25:
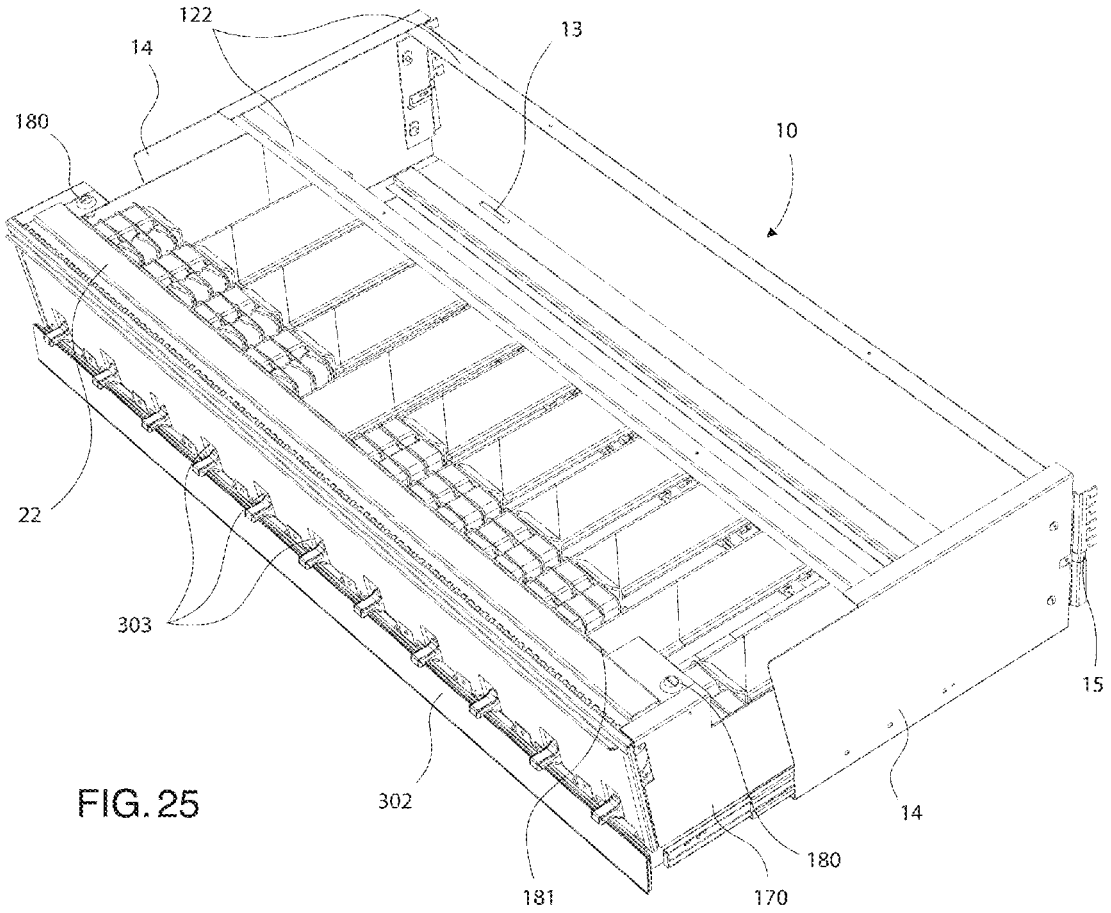
FIG. 25 illustrates a perspective view of a shelf system located in an open and/or loading position in an embodiment.

As shown in FIG. 25, the plate 22 may be attached to, connected to and/or affixed to at least one of the blocker panel 32 and/or the one or more night locks 180. In embodiments, the plate 22 may have at least one cut-out portion 181 extending at least a portion of a length of the plate 22. As a result, the at least one cut-out portion 181 may provide improved ergonomics and improved access to the pusher paddle 142 for reloading the products 160 when the shelf frame 10 may be located in the open position. Moreover, providing more than one of the night locks 180 may provide for increased security when the shelf frame 10 may be locked while the marketplace and/or the retail establishment is closed for business.

It will be appreciated that various of the above-disclosed and other features and functions, or alternatives thereof, may be desirably combined into many other different systems and/or methods. Also, various presently unforeseen or unanticipated alternatives, modifications, variations or improvements therein may be subsequently made by those skilled in the art, and are also intended to be encompassed by the present disclosure.

We claim:

1. A secure product dispensing apparatus for one or more retail items having a front side and a rear side located opposite to the front side, the apparatus comprising:

a) at least one product holder adapted for holding the one or more retail items, the at least one product holder comprising:

i) a front portion located adjacent to the front side of the apparatus;

ii) a back portion located rearward with respect to the front portion of the at least one product holder;

iii) a pusher paddle adapted for biasing the one or more retail items towards the front portion of the at least one product holder when the one or more retail items are positioned within the at least one product holder;

iv) at least one product stop ramp adapted for restraining the one or more retail items from passing from the back portion to the front portion when the one or more retail items are positioned within the at least one product holder; and v) a level actuator having associated forks configured to lift at least one retail item over the product stop ramp such that the at least one retail item is movable from the back portion to the front portion of the product holder when the one or more retail items are positioned within the at least one product holder, b) a front panel hinged at a bottom edge of the front panel to the front side of the apparatus, wherein the front panel is adapted to move to an open position or a closed position, wherein the front panel, when located in the open position, is configured to allow manual access to the front portion of the product holder, or, when located in the closed position, is configured to block manual access to the product holder, wherein at least one portion of the level actuator extends outwardly with respect to the front panel;

c) a blocker panel locatable in an engaged position or in an unengaged position, wherein the blocker panel, when located in the engaged position, is configured to block manual access to the back portion of the product holder and to allow manual access to the front portion of the product holder; and d) at least one linkage located between the front panel and the blocker panel such that the blocker panel is in the engaged position when the front panel is in the open position and the blocker panel is in the unengaged position when the front panel is in the closed position, wherein, when the one or more retail items are positioned within the at least one product holder, the at least one retail item is manually accessible from the front portion of the product holder when the front panel is located in the open position and access to the one or more retail items located in the back portion of the product holder is blocked by the blocker panel when the front panel is located in the closed position.

2. The secure product dispensing apparatus according to claim 1, further comprising:

at least one opening formed in the front panel, wherein the at least one opening is sized to receive the at least one portion of the level actuator.

3. The secure product dispensing apparatus according to claim 1, wherein the at least one portion of the level actuator is a handle that is movable in a substantially vertical direction.

4. The secure product dispensing apparatus according to claim 1, wherein the at least one portion of the level actuator extending outwardly with respect to the front panel is positioned between a top end of the front panel and a bottom end of the front panel that is located opposite to the top end of the front panel.

5. The secure product dispensing apparatus according to claim 1, wherein the pusher paddle is positioned in a forward angle with respect to the front side of the apparatus.

6. The secure product dispensing apparatus according to claim 1, further comprising:

a pivot point for the hinged front panel that is located below the level actuator.

7. The secure product dispensing apparatus according to claim 1, further comprising:

an electronic alert system coupled to at least one selected from the group comprising the front panel, the blocker panel, a handle of the front panel, a drawer locking mechanism and one or more night locks.

8. The secure product dispensing apparatus according to claim 7, wherein the electronic alert system is configured to produce an audible alert or a visual alert.

9. The secure product dispensing apparatus according to claim 7, further comprising:

at least one product sensor in electronic communication with the electronic alert system.

10. A secure product dispensing apparatus having a front side, a rear side located opposite to the front side, a top side and a bottom side located opposite to the top side, the apparatus comprising:

a) at least one product holder adapted for holding the one or more retail items, the at least one product holder comprising:

i) a front portion located adjacent to the front side of the apparatus;

ii) a back portion located adjacent to the rear side of the apparatus;

iii) a pusher paddle biased towards the front portion of the at least one product holder;

iv) at least one product stop ramp located between the front and back portions of the at least one produce holder; and v) a level actuator having associated forks for lifting above the product stop ramp, b) a front panel hinged at a bottom edge of the front panel to the front side of the apparatus adjacent to the bottom side of the apparatus, wherein the front panel is adapted to move to an open position or a closed position, wherein the front panel, when located in the open position, is configured to allow manual access to the front portion of the product holder, or, when located in the closed position, is configured to block manual access to the product holder, wherein at least one portion of the level actuator extends outwardly from an opening formed in the front panel;

c) a blocker panel locatable in an engaged position or in an unengaged position, wherein the blocker panel, when located in the engaged position, is configured to block manual access to the back portion of the product holder and to allow manual access to the front portion of the product holder; and d) at least one linkage connecting the front panel and the blocker panel, wherein the at least one portion of the level actuator is movable within the opening formed in the front panel to lift the associated forks above the stop ramp of the at least one product holder.

11. The secure product dispensing apparatus according to claim 1, wherein the at least one portion of the level actuator is a handle that is movable in a substantially vertical direction.

12. The secure product dispensing apparatus according to claim 10, further comprising:

a pivot point for the hinged front panel that is located below the level actuator.

13. The secure product dispensing apparatus according to claim 10, further comprising:

at least one retail item positioned on the at least one product holder.

14. A method for securely storing and dispensing at least one retail item, the method comprising:

connecting a product holder to a shelf frame having a front side, a back side located opposite with respect to the front side, a top side and a bottom side located opposite to the top side, wherein the product holder is adapted to hold one or more retail items and comprises:

i) a front portion located adjacent to the front side of the apparatus;

ii) a back portion located adjacent to the rear side of the apparatus;

iii) a pusher paddle adapted for biasing the one or more retail items towards the front portion of the product holder when the one or more retail items are positioned within the product holder;

iv) a product stop ramp located between the front and back portions of the product holder, where the product stop ramp is adapted to restrain the one or more retail items from passing from the back portion to the front portion of the product holder when the one or more retail items are positioned within the product holder; and v) a level actuator having associated forks configured to lift at least one retail item over the product stop ramp such that the at least one retail item is movable from the back portion to the front portion of the product holder when the one or more retail items are positioned within the at least one product holder, hinging a bottom edge of the front panel hinged to the front side of the shelf frame adjacent to the bottom side of the shelf frame, wherein the front panel is moveable to an open position or to a closed position, wherein the front panel, when located in the open position, allows manual access to the front portion of the product holder, or, when located in the closed position, blocks manual access to the front portion of the product holder, wherein at least one portion of the level actuator extends outwardly from an opening formed within the front panel; and connecting a blocker panel to the front panel, wherein the blocker panel is positionable in an engaged position or in an unengaged position, wherein the blocker panel, when located in the engaged position, blocks manual access to the back portion of the product holder and allows manual access to the front portion of the product holder, wherein the blocker panel is in the engaged position when the front panel is located in the open position and the blocker panel is in the unengaged position when the front panel is located in the closed position.

15. The method according to claim 14, further comprising:

accessing the front portion of the product holder by moving the front panel to the open position.

16. The method according to claim 14, further comprising:

blocking access to the front portion of the product holder by positioning the blocker panel in the engaged position.

17. The method according to claim 14, further comprising:

lifting the associated forks of the level actuator above the product stop ramp by moving the level actuator within the opening of the front portion.

18. The method according to claim 14, further comprising:

positioning at least one retail item within the at least one product holder.

19. The method according to claim 18, further comprising:

moving the at least one portion of the level actuator located within the opening of the front panel such that the associated forks of the level actuator lifts the at least one retail product over the product stop ramp and into the front portion of the product holder.

20. The method according to claim 19, further comprising:

manually accessing the at least one retail item from the front portion of the product holder by moving the front panel to the open position, wherein, when the front panel is located in the open position, the blocker panel blocks access to the back portion of the product holder.

* * * * *